US010751778B2

(12) United States Patent
Suzuki et al.

(10) Patent No.: US 10,751,778 B2
(45) Date of Patent: Aug. 25, 2020

(54) METHOD OF MANUFACTURING A QUENCHED MEMBER AND QUENCHED MEMBER

(71) Applicant: NIPPON STEEL CORPORATION, Tokyo (JP)

(72) Inventors: Toshiya Suzuki, Tokyo (JP); Yoshiaki Nakazawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/475,041

(22) PCT Filed: Mar. 14, 2018

(86) PCT No.: PCT/JP2018/010059
§ 371 (c)(1),
(2) Date: Jun. 28, 2019

(87) PCT Pub. No.: WO2018/168957
PCT Pub. Date: Sep. 20, 2018

(65) Prior Publication Data

US 2019/0329309 A1 Oct. 31, 2019

(30) Foreign Application Priority Data

Mar. 15, 2017 (JP) ..... 2017-049911

(51) Int. Cl.
*B21D 5/01* (2006.01)
*B21D 22/26* (2006.01)

(52) U.S. Cl.
CPC ..... *B21D 5/01* (2013.01); *B21D 22/26* (2013.01)

(58) Field of Classification Search
CPC . B21D 5/01; B21D 5/015; B21D 5/10; B21D 22/025; B21D 22/125; B21D 22/26; B21D 22/022; B21D 22/20; C21D 1/673
See application file for complete search history.

(56) References Cited

U.S. PATENT DOCUMENTS 2,330,207 A * 9/1943 England ..... B21C 37/108 413/1
4,734,971 A * 4/1988 Dupasquier ..... B21D 39/03 138/166

(Continued)

FOREIGN PATENT DOCUMENTS

EP 2134573 12/2009
JP 9-267633 A 10/1997

(Continued)

OTHER PUBLICATIONS

Machine translation of JP09267633, 22 Pages. (Year: 1997).*

(Continued)

*Primary Examiner* — Gregory D Swiatocha
(74) *Attorney, Agent, or Firm* — Birch, Stewart, Kolasch & Birch, LLP

(57) ABSTRACT

A method of manufacturing a quenched member includes heating a pressed intermediate article to an Ac3 transformation point of a steel sheet or higher, the intermediate article having been processed so as to have a rectangular cross-section and so as to include a terminal portion at which two terminal edges of the steel sheet are aligned with each other at a same side of the rectangular cross-section, and quenching the heated intermediate article inside a die.

12 Claims, 20 Drawing Sheets

(56) References Cited

U.S. PATENT DOCUMENTS

| | | | | |
|---|---|---|---|---|
| 4,907,626 | A * | 3/1990 | Mori | B21D 53/16 138/156 |
| 6,185,978 | B1 * | 2/2001 | Sundgren | B21D 7/165 72/364 |
| 9,206,843 | B2 * | 12/2015 | Hauk | F16C 33/14 |
| 9,278,595 | B2 * | 3/2016 | Ohta | B60G 7/02 |
| 9,681,594 | B2 * | 6/2017 | Kimoto | B60R 16/0215 |
| 10,112,641 | B2 * | 10/2018 | Johr | B62D 1/16 |
| 10,160,018 | B2 * | 12/2018 | Higai | B21C 37/15 |
| 2001/0020491 | A1 | 9/2001 | Kondou et al. | |
| 2004/0164566 | A1 | 8/2004 | Jaeger et al. | |
| 2010/0218375 | A1 | 9/2010 | Saito et al. | |
| 2014/0144560 | A1 | 5/2014 | Yamano et al. | |
| 2015/0151344 | A1 | 6/2015 | Ueno et al. | |
| 2018/0148807 | A1 * | 5/2018 | Richardson | B21D 22/208 |

FOREIGN PATENT DOCUMENTS

| | | | |
|---|---|---|---|
| JP | 9267633 | A * | 10/1997 |
| JP | 3114918 | B2 | 12/2000 |
| JP | 2001-314923 | A | 11/2001 |
| JP | 2002-212640 | A | 7/2002 |
| JP | 3974324 | B2 | 9/2007 |
| JP | 4040840 | B2 | 1/2008 |
| JP | 2008-264853 | A | 11/2008 |
| JP | 2010-75993 | A | 4/2010 |
| JP | 2010-162596 | A | 7/2010 |
| JP | 2011-617 | A | 1/2011 |
| JP | 2012-152765 | A | 8/2012 |
| JP | 5886325 | B2 | 3/2016 |
| KR | 10-1682868 | B1 | 12/2016 |
| WO | WO 02/064277 | A1 | 8/2002 |
| WO | WO 2005/072234 | A2 | 8/2005 |
| WO | WO 2008/129654 | A1 | 10/2008 |

OTHER PUBLICATIONS

Korean Office Action for corresponding Korean Application No. 10-2019-7018314, dated Aug. 5, 2019, with partial English translation.

Partial Supplementary European Search Report, dated Nov. 20, 2019, for corresponding European Application No. 18766980.9.

International Search Report for PCT/JP2018/010059 (PCT/ISA/210) dated Jun. 12, 2018.

Written Opinion of the International Searching Authority for PCT/JP2018/010059 (PCT/ISA/237) dated Jun. 12, 2018.

* cited by examiner

METHOD OF MANUFACTURING A QUENCHED MEMBER AND QUENCHED MEMBER

TECHNICAL FIELD

The present disclosure relates to a method of manufacturing a quenched member and a quenched member.

BACKGROUND ART

For example, methods of manufacturing a hollow pipe-body from a metal plate are disclosed in the specifications of Japanese Patent No. 3114918 (Patent Document 1), Japanese Patent No. 5886325 (Patent Document 2), Japanese Patent No. 3974324 (Patent Document 3), and Japanese Patent No. 4040840 (Patent Document 4).

In the manufacturing method disclosed in Patent Document 1, a shape which is curved in a longitudinal direction is formed in a first forming process, and a pipe-shaped cross section is formed in a subsequent forming process.

In the manufacturing method disclosed in Patent Document 2, similarly to in Patent Document 1, a shape which is curved in a longitudinal direction is formed in a first forming process, and a pipe-shaped cross section is formed in a subsequent forming process. A core is used as a tool to process one longitudinal direction portion into a rectangular cross-section.

In the manufacturing methods disclosed in Patent Document 3 and Patent Document 4, in a first processing step, a wall portion with a seam is formed in a finished pipe-body. In a second processing step, an angle between one wall portion, which faces the seam, and another wall portion, which is adjacent to the one wall portion, is configured to be larger than an angle of the finished pipe-body.

In a third processing step, a protruding curved surface, which protrudes toward the outside, is formed at the one wall portion by an external force applied to the other wall portion. Then, in a fourth processing step, the protruding curved surface is deformed and flattened by an external force applied to the one wall portion, and the pipe-body in which a pair of edges contact each other closely is formed by spring-back force.

SUMMARY OF INVENTION

Technical Problem

In the manufacturing methods described in Patent Document 1 and Patent Document 2, forming is straightforward in a case in which the metal plate is thick. However, in a case in which the metal plate is thin, buckling, wrinkling, and the like are likely to occur at a curved-portion when curving along the longitudinal direction to form the pipe shape.

Further, in a case in which a core is used as a tool to form a rectangular cross-section, a complex die structure is required in order to remove the core along the longitudinal direction, and costs increase. Moreover, it is difficult to maintain the cross-sectional shape at a center portion in the longitudinal direction because the core cannot be used along the entire longitudinal direction.

Furthermore, in cold processing, when high strength steel sheet is used to form a shape curving along a longitudinal direction, the amount of spring-back after the forming increases. It is therefore difficult to obtain the desired curved shape.

In addition, in Patent Document 3 and Patent Document 4, methods of manufacturing a hollow pipe-body are described. However, methods of curving the hollow pipe-body in the longitudinal direction are not described.

The present disclosure has been made in view of the above problems, and an object of the present disclosure is to form a hollow member that has a rectangular cross-section that is curved in the longitudinal direction, with excellent dimensional precision.

Solution to Problem

A method of manufacturing a quenched member that solves the above problems includes heating a pressed intermediate article to an Ac3 transformation point of a steel sheet or higher, the intermediate article having been processed so as to have a rectangular cross-section and so as to include a terminal portion at which two terminal edges of the steel sheet are aligned with each other at a same side of the rectangular cross-section, and quenching the heated intermediate article inside a die.

Namely, after the pressed intermediate article that has been processed into a rectangular cross-section in which the two terminal edges of the steel sheet are aligned with each other has been heated to the Ac3 transformation point or higher, the pressed intermediate article is hot pressed and quenched inside the die to form a quenched member. Therefore, even if a quenched member that curves along the longitudinal direction is formed using a thin steel sheet, it is possible to form the quenched member with high strength and excellent dimensional precision of the curved shape, and the occurrence of buckling and wrinkles can be suppressed.

Furthermore, a cross-sectional shape of the pressed intermediate article to be quenched is substantially closed. As a result, heat escapes less readily from the heated pressed intermediate article than in cases in which a flat steel sheet is heated and hot pressed, and it is possible to suppress a drop in temperature. Therefore, it is possible to extend permissible duration from the end of heating to the start of hot pressing.

Thus, quenching defects resulting from a drop in temperature are reduced, resulting in a highly robust manufacturing process.

Advantageous Effects of Invention

According to the method of manufacturing a quenched member of the present disclosure, it is possible to form a hollow member that has a rectangular cross-section that is curved in the longitudinal direction, with excellent dimensional precision.

DESCRIPTION OF EMBODIMENTS

First Embodiment

Figure 1:
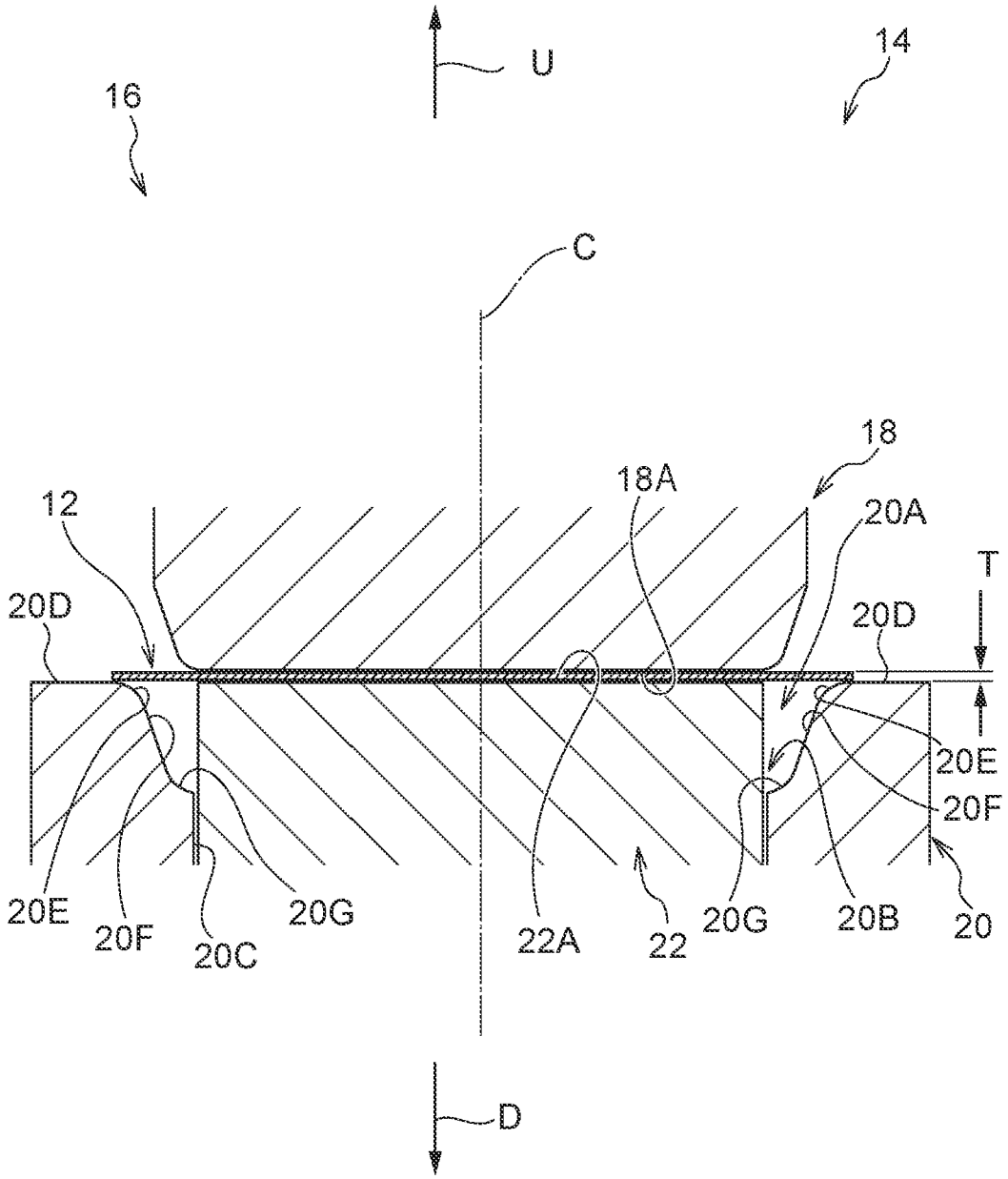
FIG. 1 is a cross-sectional view illustrating a first process in a method of manufacturing a quenched member according to a first embodiment, taken from in front of a pressing apparatus.

Explanation follows regarding a first embodiment, with reference to FIG. 1 to FIG. 17.

FIG. 1 to FIG. 12 illustrate a manufacturing method for a quenched member according to the present embodiment. FIG. 13 illustrates a quenched member 10 pressed by use of the method of manufacturing a quenched member. The quenched member 10 is an elongated member, and is, for example, a reinforcement member. The quenched member 10 has a rectangular cross-section, and is curved in the length-direction NH.

(Steel Sheet)

A pressing is preferable using a steel sheet 12 in which a ratio of a height H of the member in a curving direction (U direction) to a sheet-thickness T of the quenched member 10 in a lateral cross-section, is 40 or less. In the present embodiment, the steel sheet 12, in which H/T=20, is used (see FIG. 15).

A steel material used as the steel sheet 12 has a chemical composition containing C: from 0.1% to 0.8%, Si: from 0.001% to 2.0%, Mn: from 0.5% to 3.0%, P: 0.05% or less, and S: 0.01% or less, as mass %. The steel material also preferably has a chemical composition containing, sol. Al: from 0.001% to 1.0%, N: 0.01% or less, and B: 0.01% or less, with the remainder being made up of Fe and impurities, as mass %. The chemical composition may also contain one element or two or more elements selected from a group consisting of Ti, Nb, V, Cr, Mo, Cu, and Ni, instead of some of the Fe.

When a carbon C content is too low, quenching may have little effect, and strength of a product will decrease. Accordingly, in the present embodiment, the carbon content of the steel sheet 12 is at least 0.1 mass %.

On the other hand, when the carbon C content is too high, the hardness may become too great, and toughness of a product will lack. Accordingly, in the present embodiment, the carbon content of the steel sheet 12 is 0.8 mass % or less. The carbon content of the steel sheet 12 is set from 0.1 mass % to 0.8 mass %.

Si is preferably controlled so as to be in a range of from 0.001 mass % to 2.0 mass %. Si is an element that has an effect of enhancing strength after quenching by preventing ductility being degraded, or improving ductility, according to suppressing the formation of carbides in a cooling process at which an austenite phase is transformed to a low-temperature transformation-phase. When the Si content is below 0.001 mass %, it is difficult to obtain above-mentioned effect. Therefore, the Si content is 0.001 mass % or more, preferably.

Additionally, ductility is further improved when the Si content is 0.05 mass % or more. Therefore, the Si content is 0.05 mass % or more, further preferably. On the other hand, when the Si content exceeds 2.0 mass %, above-mentioned effect becomes saturated, and economic disadvantage will occur, and also, surface texture degradation will become large. Therefore, the Si content is 2.0 mass % or less, preferably. More preferably, the Si content is 1.5 mass % or less.

Mn is preferably controlled so as to be in a range of from 0.5 mass % to 3.0 mass %. Mn is an element that is highly effective in improving properties of steel quenching and securing consistency in strength after quenching. However, when Mn content is less than 0.5 mass %, the effect cannot be enough achieved even under rapid-cooling condition, and it becomes very difficult to secure a tensile strength of 1200 MPa or more, as a strength after quenching. Therefore, the Mn content is 0.5 mass % or more, preferably.

P is preferably controlled so as to be 0.05 mass % or less. Although P is an unavoidable impurity which is contained in steel in general, P might be included intentionally because P has an effect of enhancing strength by solid solution strengthening. However, when the P content exceeds 0.05 mass %, significant deterioration in resistance weldability between the member of the present embodiment and other members will occur. Therefore, the P content is 0.05 mass % or less, preferably. More preferably, the P content is 0.02 mass % or less. In order to obtain the above-mentioned effect more reliably, the P content is preferably 0.003 mass % or more.

S is preferably controlled to so as to be 0.01 mass % or less. S is an unavoidable impurity which is contained in steel, and bonds with Mn or Ti to precipitate and form sulfides. The lower the S content, the better, because an interface between the precipitate and the main phase may act as a start point for fractures when the amount of the precipitate increases excessively. Such a detrimental effect becomes significant when the S content exceeds 0.01 mass %. Therefore, the S content is 0.01 mass % or less preferably. More preferably the S content is 0.003 mass % or less, and is 0.0015 mass % or less further preferably.

Sol. Al is preferably controlled so as to be in a range of from 0.001 mass % to 1.0 mass %. Al is an element that has an effect of consolidating steel materials by removing oxygen from the steel, and is also an element that has an effect of improving a yield of carbo-nitride forming elements such as Ti. The above-mentioned effect is difficult to obtain when the sol. Al content is below 0.001 mass %. Therefore, the sol. Al content is 0.001 mass % or more, preferably. More preferably the sol. Al content is 0.015 mass % or more. On the other hand, when the sol. Al content exceeds 1.0 mass %, decrease in weldability becomes significant, and deterioration in surface properties becomes significant due to increase of oxide inclusions. Therefore, the sol. Al content is 1.0 mass % or less, preferably. More preferably the sol. Al content is 0.080 mass % or less.

N is preferably controlled so as to be 0.01 mass % or less. N is an unavoidable impurity contained in steel, and is preferably as low as possible in the perspective of weldability. When an N content exceeds 0.01 mass %, decrease in weldability becomes significant. Therefore, the N content is 0.01 mass % or less, preferably. More preferably the N content is 0.006 mass % or less.

B is preferably controlled so as to be 0.01 mass % or less. B is an element that has an effect of raising low temperature toughness. Therefore, B may be contained. However, when a content contained exceeds of 0.01 mass %, hot rolling becomes difficult because of deterioration in hot workability. Therefore, the B content is preferably 0.01 mass % or less. Additionally, in order to obtain the benefits of the above-mentioned effect more reliably, the B content is 0.0003 mass % or more, further preferably.

Ti, Nb, V, Cr, Mo, Cu, and Ni may be added on demand as other addition elements, for the purpose to improve steel quenching properties and to secure strength consistently after quenching.

<First Process>

Figure 2:
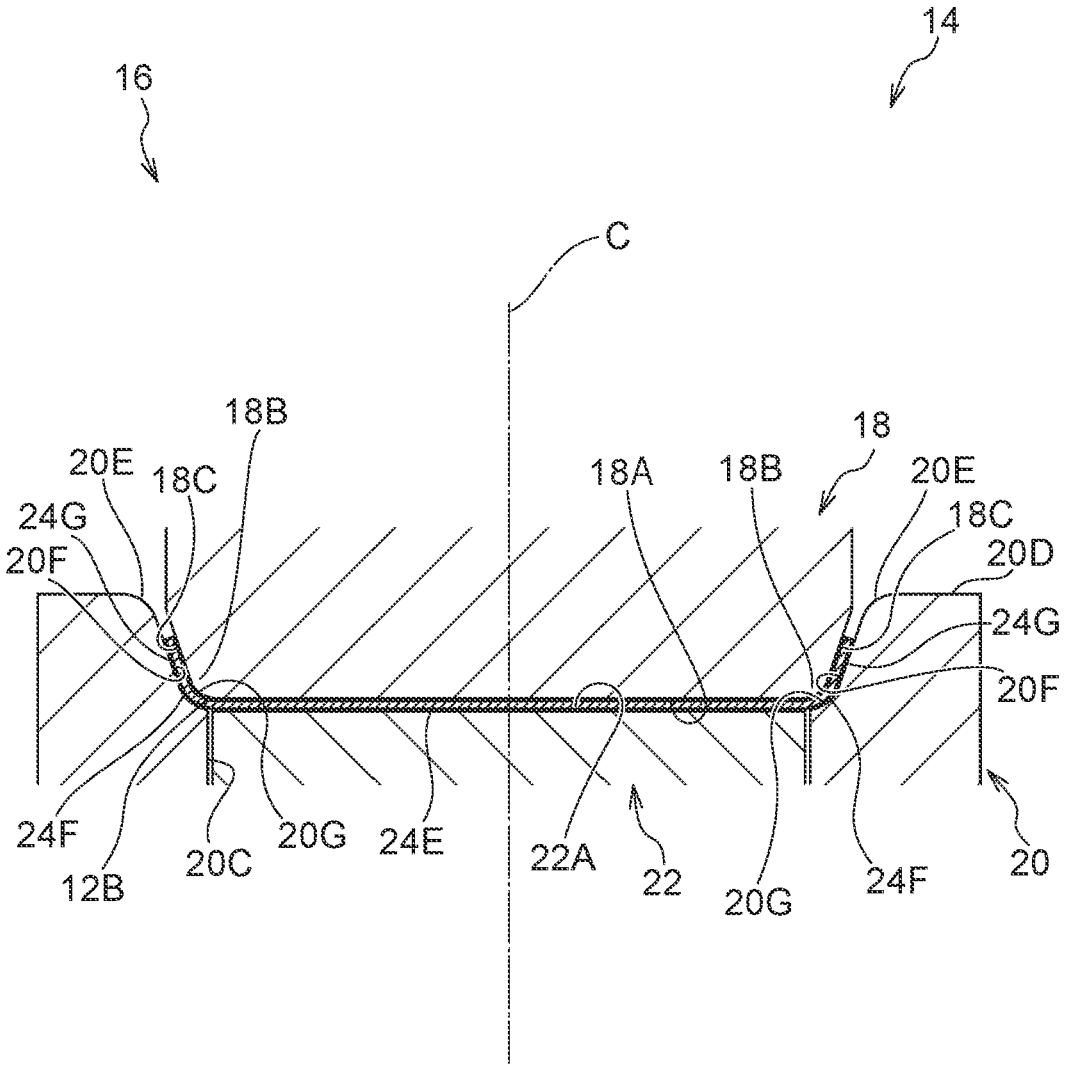
FIG. 2 is a cross-sectional view illustrating the first process following on from FIG. 1, taken from in front of the pressing apparatus.

As illustrated in FIG. 1 and FIG. 2, when forming the quenched member 10, the steel sheet 12 is cold-pressed by a first pressing apparatus 16 in a first process 14 as a part of a pressing process to form a pressed intermediate article.

(Structure of First Pressing Apparatus)

FIG. 1 and FIG. 2 illustrate the first pressing apparatus. The first pressing apparatus 16 includes a first upper die 18 and a first lower die 20. A pad 22 is provided at the first lower die 20.

A recess 20A which opens on upper-side U is formed at a central region of the first lower die 20, and a pad housing portion 20C is provided at a bottom-portion 20B of the recess 20A.

An inner surface of the recess 20A of the first lower die 20 includes curved-portions 20E extending from upper end-surfaces 20D of the first lower die 20, and recess wall-surfaces 20F inclined toward the die-center C on progression downward from the curved-portions 20E. Also, the inner surface of the recess 20A includes recess corners 20G curved toward the die-center C from lower edges of the recess wall-surfaces 20F. The pad housing portion 20C is provided between the recess corners 20G.

The pad 22 is provided in the pad housing portion 20C of the first lower die 20. The pad 22 is coupled to the first lower die 20 through a pad pressurizer. The illustration of the pad pressurizer in the drawing is omitted. The pad pressurizer is, for example, implemented by a gas cushion, hydraulic device, spring, electrically-driven device, or the like, and moves the pad 22 along a pressing direction which is upper-side U or lower-side D with respect to the first lower die 20.

A top surface 22A of the pad 22 is formed so as to be flat, and as illustrated in FIG. 2, at the point of bottom dead center at which the pad 22 is housed in the pad housing portion 20C, a lower edge of each of the recess corners 20G is positioned on an extension line of the top surface 22A. In this state, the top surface 22A of the pad 22 and each of the recess wall-surfaces 20F implement an obtuse angle.

As illustrated in FIG. 1, the first upper die 18 is disposed opposing the first lower die 20, and the first upper die 18 is coupled to a moving apparatus. The illustration of the moving apparatus in the drawing is omitted. The moving apparatus is, for example, implemented by a hydraulic device, an electrically-driven device, or the like, and moves the first upper die 18 along the pressing direction which is upper-side U or lower-side D with respect to the first lower die 20.

A lower end portion of the first upper die 18 has a shape corresponding to the recess 20A of the first lower die 20. As illustrated in FIG. 2, at the point of bottom dead center at which the lower end portion of the first upper die 18 is housed in the recess 20A of the first lower die 20, a bottom surface 18A of the first upper die 18 faces the top surface 22A of the pad 22. On the other hand, curved-shoulders 18B that constitute corners of the first upper die 18 face the recess corners 20G of the first lower die 20, and inclined-surfaces 18C extending from the shoulders 18B face the recess wall-surfaces 20F. The inclined-surfaces 18C and the recess wall-surfaces 20F have corrugated shapes. The illustration of the corrugated shapes in the drawing is omitted.

(First Process Using First Pressing Apparatus)

When pressing is performed by use of the first pressing apparatus 16, as illustrated in FIG. 1, the pad 22 is raised by the pad pressurizer, and the top surface 22A of the pad 22 is kept at the same height as the upper end-surface 20D of the first lower die 20. In this state, the steel sheet 12 is set on the top surface 22A of the pad 22, and the first upper die 18 is lowered by the moving apparatus, such that the steel sheet 12 is clamped between the bottom surface 18A of the first upper die 18 and the top surface 22A of the pad 22.

Then, as illustrated in FIG. 2, the first upper die 18 is lowered by the moving apparatus such that the pad 22 retreats into the pad housing portion 20C, and the lower end portion of the first upper die 18 is inserted into the recess 20A of the first lower die 20 (see FIG. 1).

Then, a portion of the steel sheet 12 pressed by the bottom surface 18A of the first upper die 18 and the top surface 22A of the pad 22 becomes a flat portion 24E. And, portions of the steel sheet 12 pressed by the shoulders 18B of the first upper die 18 and the recess corners 20G of the first lower die 20 become bent portions 24F. And, portions of the steel sheet 12B pressed by the inclined-surfaces 18C of the first upper die 18 and the recess wall-surfaces 20F of the first lower die 20 become flanges 24G.

(First Pressed-Article)

Figure 3:
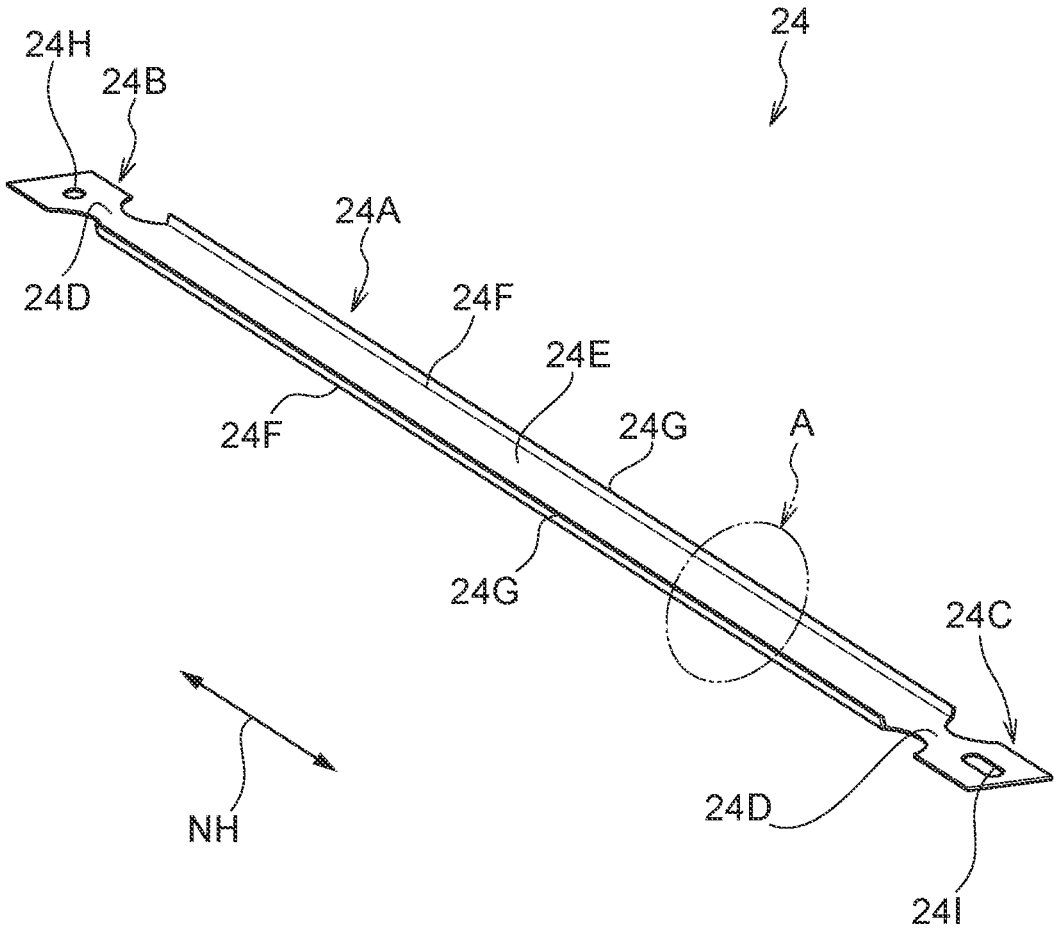
FIG. 3 is a perspective view illustrating an article pressed in the first process.

FIG. 3 is a view illustrating a first pressed-article 24 pressed by use of the first pressing apparatus 16 in the first process 14. A first supporting-portion 24B and a second supporting-portion 24C, which are removed in a final process, are provided at end portions of a main body 24A of the first pressed-article 24 through neck portions 24D which has a narrow width.

The main body 24A is formed in an elongated shape. The main body 24A includes the flat portion 24E that is continuous to the first supporting-portion 24B and the second supporting-portion 24C, the bent portions 24F formed on side-edges of the flat portion 24E, and the flanges 24G extending from the bent portions 24F. Obtuse angles are implemented between the flat portion 24E and the flanges 24G of the main body 24A. A round hole 24H is formed at the first supporting-portion 24B, and an elongated hole 24I extending along the length-direction NH of the first pressed-article 24 is formed on the second supporting-portion 24C.

Figure 4:
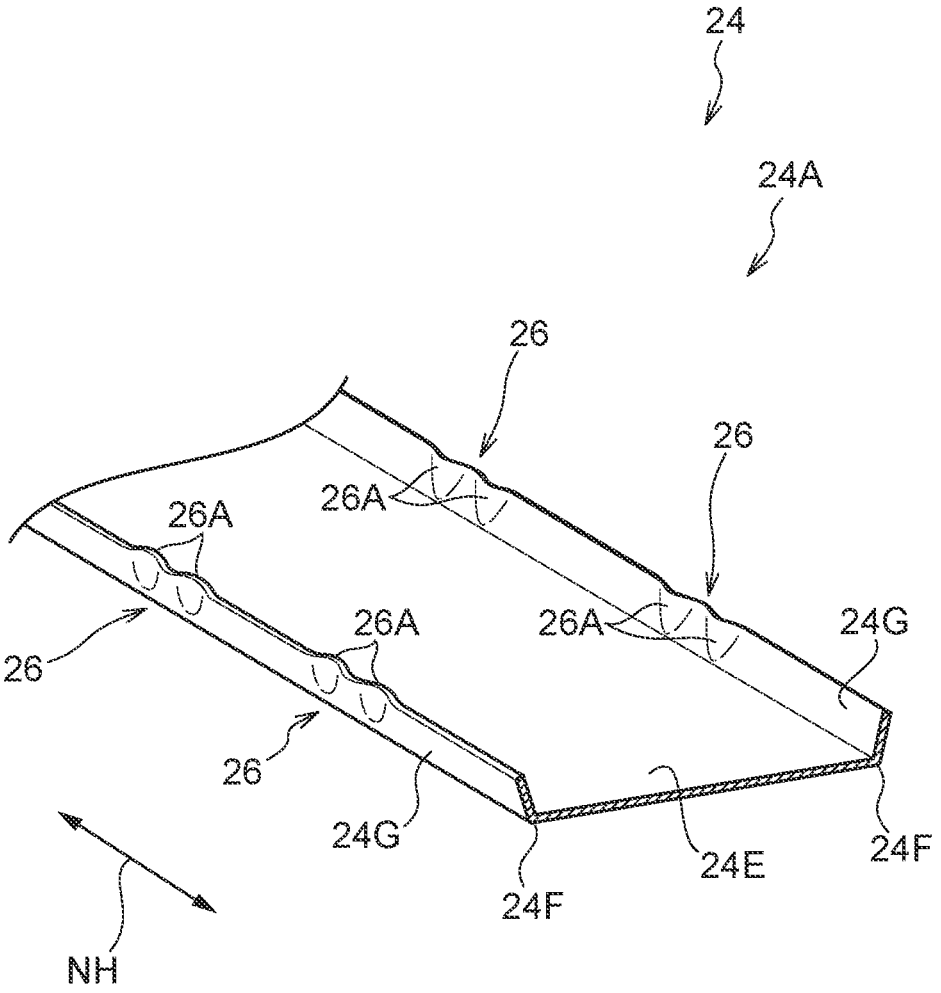
FIG. 4 is an enlarged view of section A in FIG. 3.

As illustrated in FIG. 4, undulating portions 26 which is implemented in the first process 14 are formed on the flanges 24G at gaps in the length-direction NH. The undulating portions 26 are constituted by pairs of curved-portions 26A which are curved so as to project toward the side of the opposing flange 24G. Between Undulating shapes constituted by the curved-portions 26A of the flange 24G on one-side and undulating shapes constituted by the curved-portions 26A of the flange 24G on the other side, phases are offset with respect to each other by half a period in the length-direction NH.

<Second Process>

Figure 5:
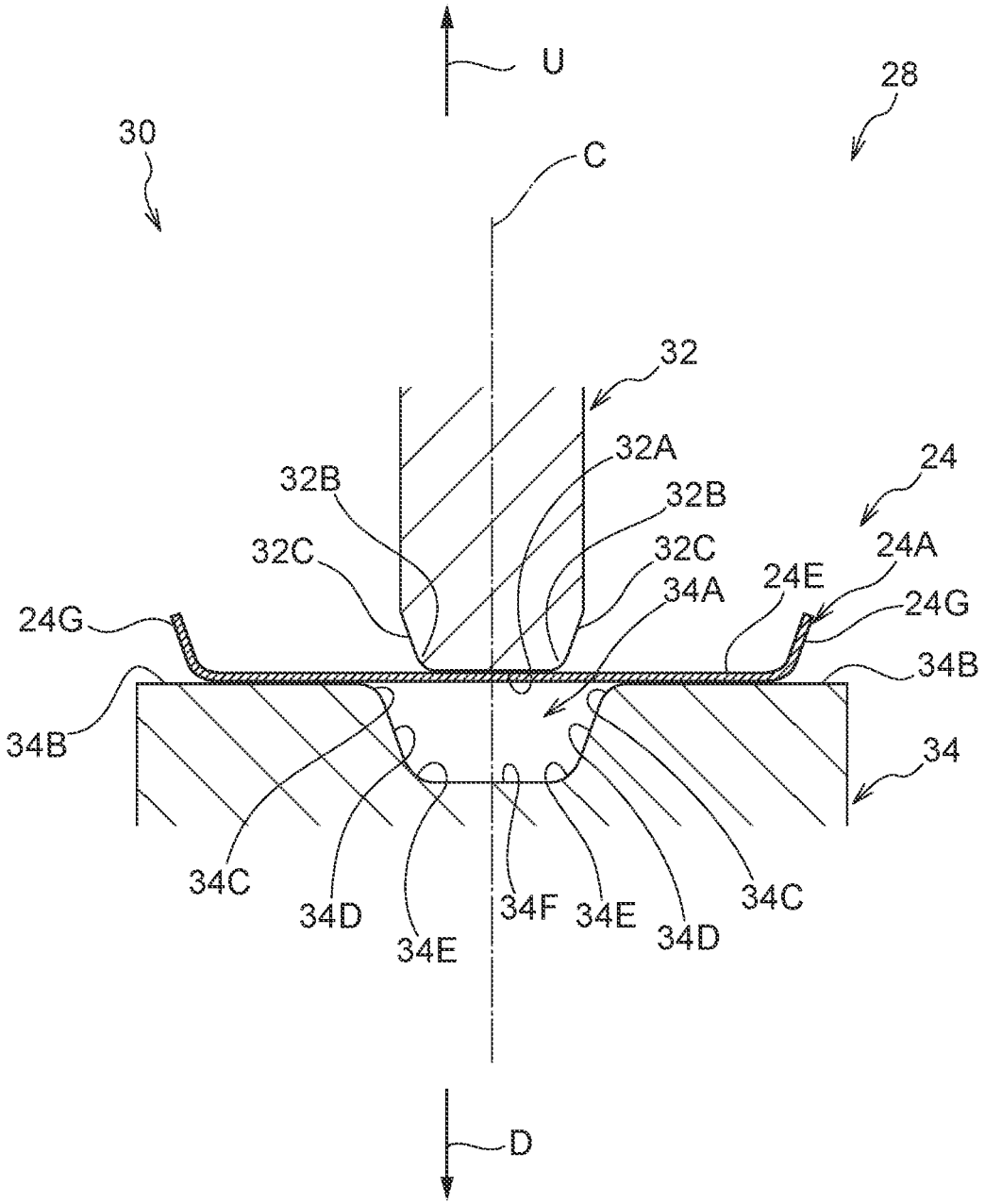
FIG. 5 is a cross-sectional view illustrating a second process in the method of manufacturing a quenched member according to a first embodiment, taken from in front of a pressing apparatus.
Figure 6:
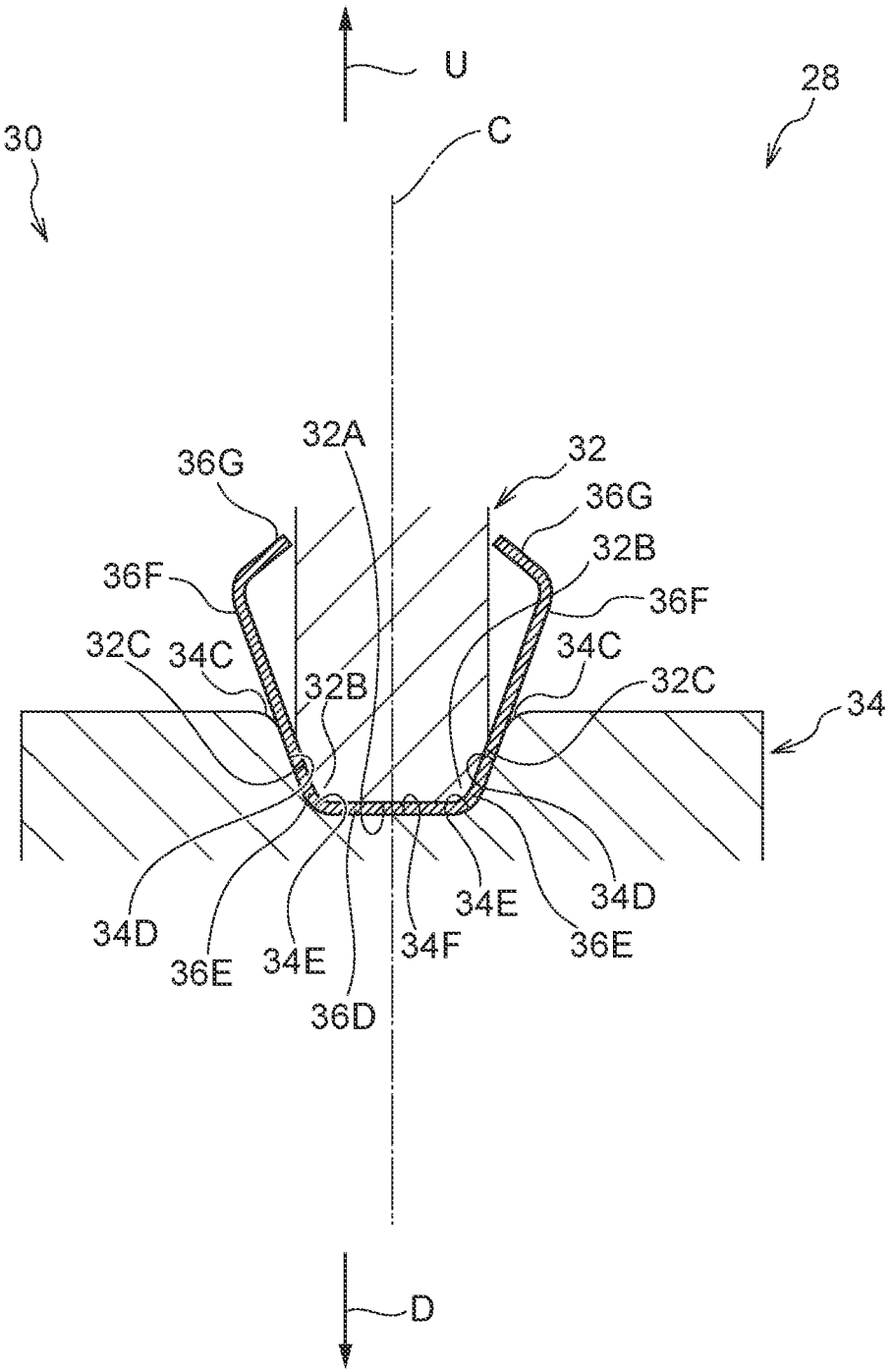
FIG. 6 is a cross-sectional view illustrating the second process following on from FIG. 5, taken from in front of the pressing apparatus.

As illustrated in FIG. 5 and FIG. 6, the first pressed-article 24 pressed in the first process 14 is cold-pressed by a second pressing apparatus 30 in a second process 28.

(Structure of Second Pressing Apparatus)

As illustrated in FIG. 5, the second pressing apparatus 30 includes a second upper die 32 and a second lower die 34.

A recess 34A which open on upper-side U is formed at a central region of the second lower die 34. The opening width of the recess 34A is shorter than a width dimension of the flat portion 24E of the first pressed-article 24.

An inner surface of the recess 34A of the second lower die 34 includes curved-portions 34C extending from upper end-surfaces 34B of the second lower die 34, and recess wall-surfaces 34D inclined toward the die-center C on progression downward from the curved-portions 34C. An inner surface of the recess 34A includes recess corners 34E curving toward the die-center C from lower edges of the recess wall-surfaces 34D. A flat recess bottom face 34F is provided between the recess corners 34E, and obtuse angles are formed between the recess bottom face 34F and the recess wall-surfaces 34D.

The second upper die 32 is disposed opposing the second lower die 34, and the second upper die 32 is coupled to a moving apparatus. The illustration of the moving apparatus in the drawing is omitted. The moving apparatus is, for example, constituted by a hydraulic device, an electrically-driven device, or the like, and moves the second upper die 32 along a pressing direction which is upper-side U or lower-side D with respect to the second lower die 34.

A lower end portion of the second upper die 32 has a shape corresponding to the recess 34A of the second lower die 34. As illustrated in FIG. 6, at the point of bottom dead center at which the lower end portion of the second upper die 32 is housed in the recess 34A (see FIG. 5) of the second lower die 34, a bottom surface 32A of the second upper die 32 faces the recess bottom face 34F of the second lower die 34. On the other hand, curved-shoulders 32B that constitute corners of the second upper die 32 face the recess corners 34E of the second lower die 34, and inclined-surfaces 32C extending from the shoulders 32B face the recess wall-surfaces 34D.

(Second Process Using Second Pressing Apparatus)

When pressing is performed by use of the second pressing apparatus 30, as illustrated in FIG. 5, the main body 24A of the first pressed-article 24 is set on the second lower die 34, and both sides of the flat portion 24E are supported by the upper end-surfaces 34B on either side of the recess 34A of the second lower die 34. At the time, the round hole 24H of the first supporting-portion 24B and the elongated hole 24I of the second supporting-portion 24C in the first pressed-article 24 are utilized so as to position the first pressed-article 24 (see FIG. 3), although the illustration in the drawing is omitted. Similar also applies in subsequent pressing processes.

In this state, as illustrated in FIG. 6, the second upper die 32 is lowered by the moving apparatus such that the lower end portion of the second upper die 32 is inserted into the recess 34A of the second lower die 34.

Then, the flat portion 24E of the main body 24A of the first pressed-article 24 is pressed by the bottom surface 32A of the second upper die 32 and the recess bottom face 34F of the second lower die 34 so as to implement a narrow-width flat-portion 36D. And, the flat portion 24E is pressed by the shoulders 32B of the second upper die 32 and the recess corners 34E of the second lower die 34 so as to implement bent portions 36E, and is pressed by the inclined-surfaces 32C of the second upper die 32 and the recess wall-surfaces 34D of the second lower die 34 so as to implement upwardly projecting upright-portions 36F.

(Second Pressed-Article)

Figure 7:
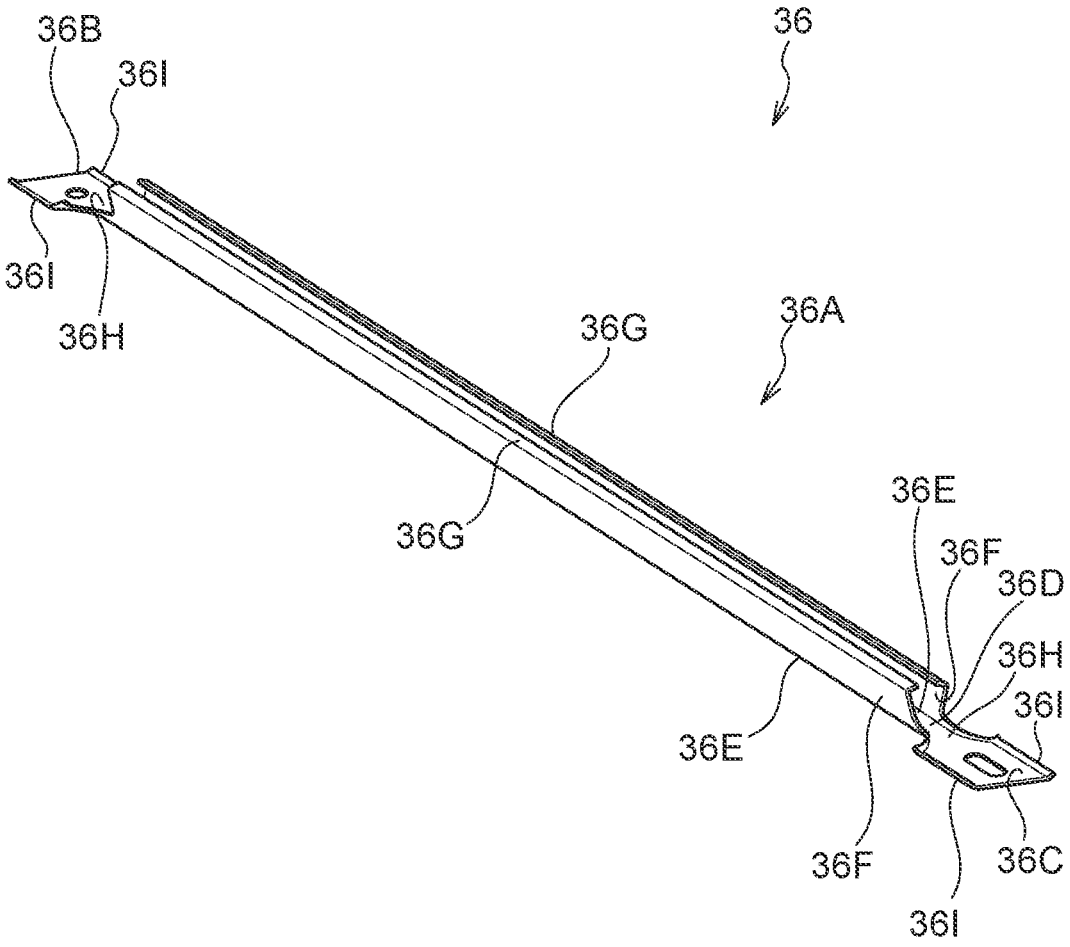
FIG. 7 is a perspective view illustrating an article pressed in the second process.

FIG. 7 is a view illustrating a second pressed-article 36 pressed by use of the second pressing apparatus 30 in the second process 28. A main body 36A of the second pressed-article 36 includes the narrow-width flat-portion 36D that is continuous to a first supporting-portion 36B and a second supporting-portion 36C, the bent portions 36E formed on side-edges of the narrow-width flat-portion 36D, and the upright-portions 36F extending from the bent portions 36E. Obtuse angles are implemented between the narrow-width flat-portion 36D and the upright-portions 36F.

Terminal edges of flanges 36G (corresponding to the flanges 24G of the first pressed-article 24) formed on the respective upright-portions 36F are separated from each other, and the main body 36A is open between the flanges 36G.

On the other hand, reinforcement ribs 361 are bent continuously to the upright-portions 36F at side-edges of neck portions 36H which is formed and couple the main body 36A to the first supporting-portion 36B and to the second supporting-portion 36C, at side-edges of the first supporting-portion 36B, and at side-edges of the second supporting-portion 36C. Therefore, coupling portions between the main body 36A and the first supporting-portion 36B and between the main body 36A and the second supporting-portion 36C are reinforced.

<Third Process>

Figure 8:
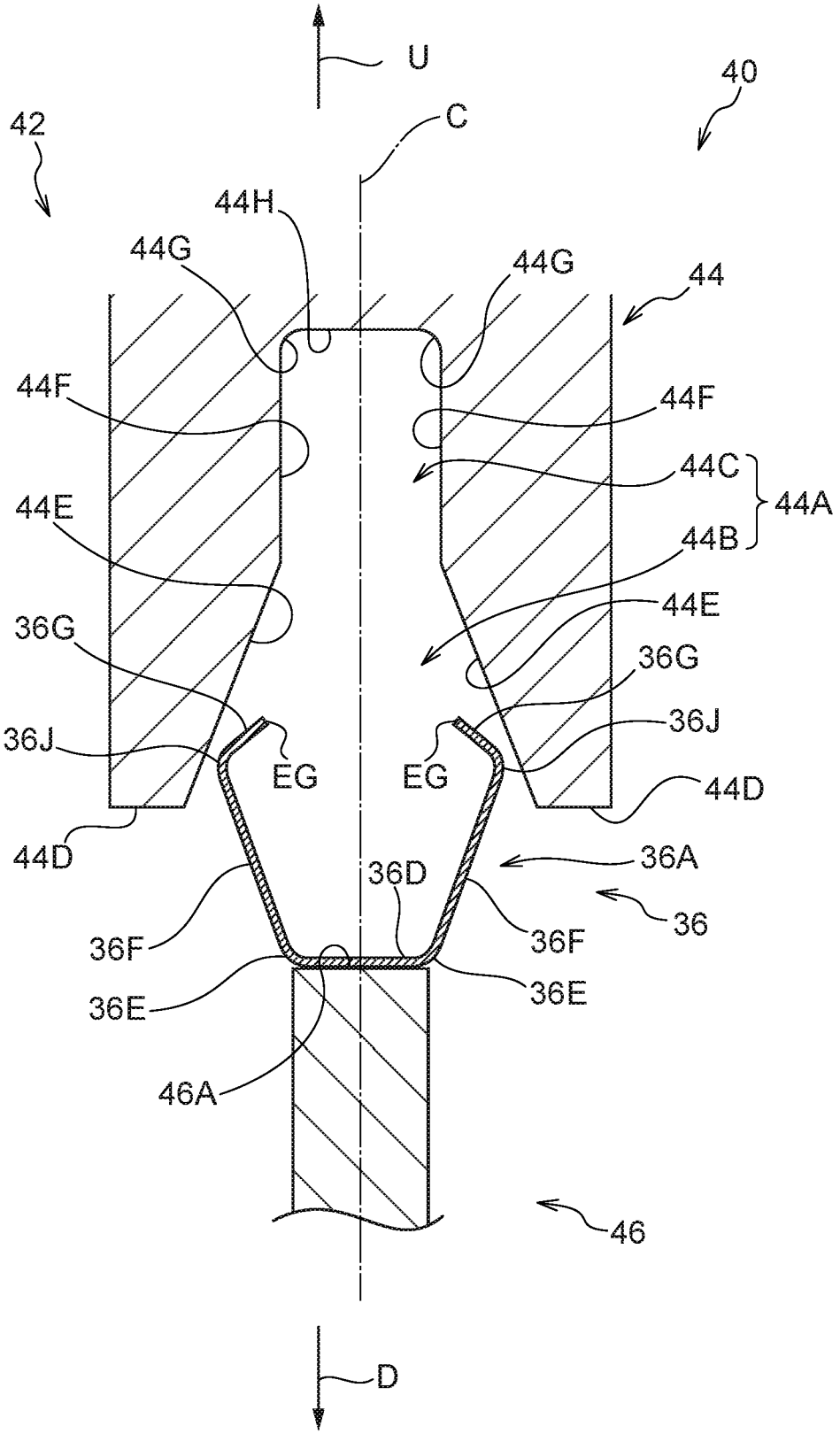
FIG. 8 is a cross-sectional view illustrating a third process in the method of manufacturing a quenched member according to a first embodiment, taken from in front of a pressing apparatus.
Figure 9:
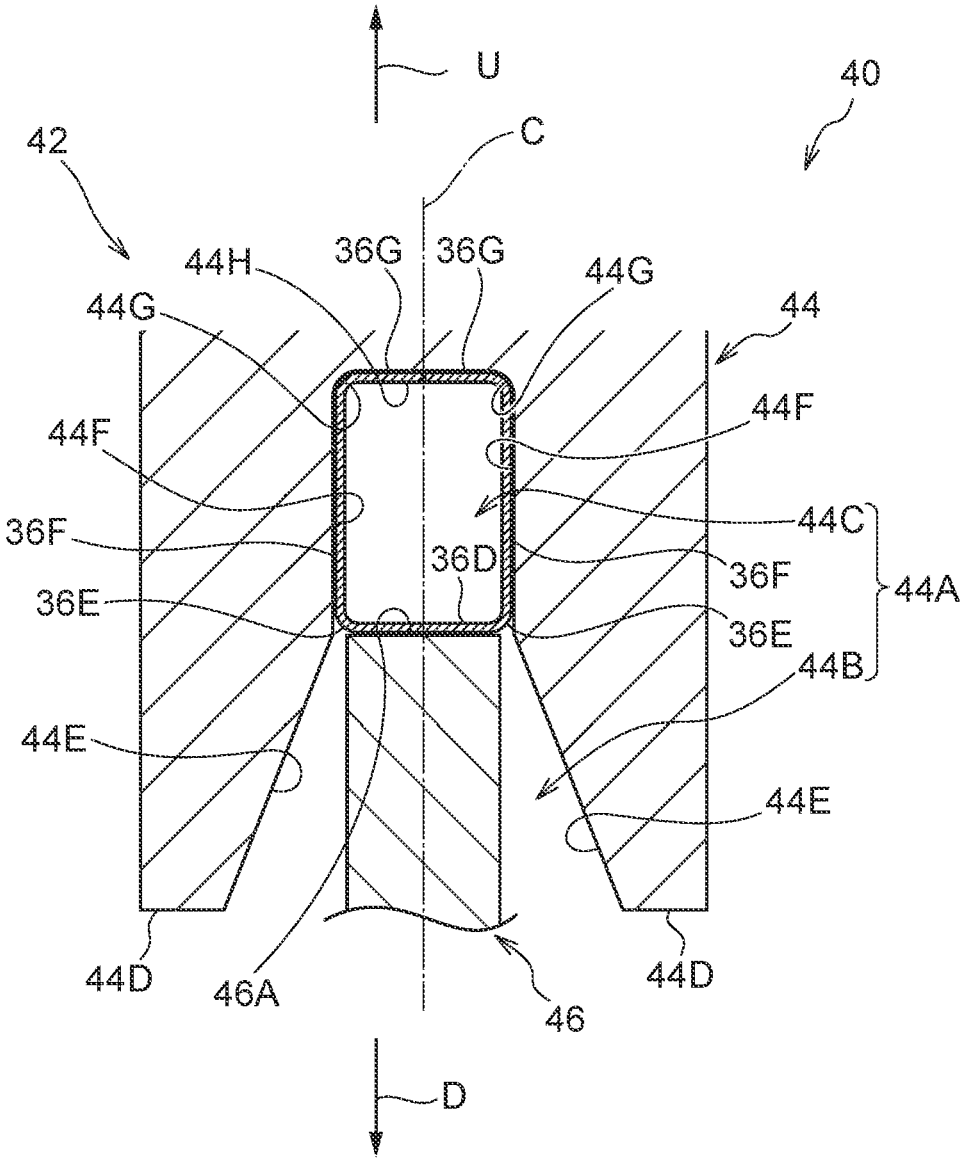
FIG. 9 is a cross-sectional view illustrating the third process following on from FIG. 8, taken from in front of the pressing apparatus.

As illustrated in FIG. 8 and FIG. 9, the second pressed-article 36 pressed in the second process 28 is cold-pressed by a third pressing apparatus 42 in a third process 40.

(Structure of Third Pressing Apparatus)

As illustrated in FIG. 8, the third pressing apparatus 42 includes a third upper die 44 and a third lower die 46.

The third lower die 46 has a rectangular and protruding shape in cross-section, and includes a top surface 46A which has a length and a width so that the narrow-width flat-portion 36D of the main body 36A of the second pressed-article 36 is able to be placed on. The cross-sectional shape of the third lower die 46 is not limited to a rectangular shape, and may be a trapezoidal shape as long as it is capable of being housed between guiding-surfaces 44E of the third upper die 44 which is described later.

The third upper die 44 is disposed opposing the third lower die 46. The third upper die 44 is coupled to a moving apparatus. The illustration of the moving apparatus in the drawing is omitted. The moving apparatus is, for example, implemented by a hydraulic device, an electrically-driven device, or the like, and moves the third upper die 44 toward a pressing direction which is upper-side U or lower-side D with respect to the third lower die 46.

A recess 44A which opens on the third lower die 46 side is formed at a central region of the third upper die 44. The recess 44A includes a guiding-section 44B which configures a third lower die 46 side of the recess 44A, and a pressing-section 44C which configures an interior side of the guiding-section 44B.

The pressing-section 44C of the recess 44A is formed with a rectangular cross-section, and has the same opening width as the opening width of an interior side of the guiding-section 44B.

The guiding-section 44B of the recess 44A has an opening width that becomes shorter on progression from the third lower die 46 side toward the interior side. The interior side is the upper U side. The opening width of the guiding-section 44B at lower end surfaces 44D of the third upper die 44 is longer than a width dimension from an outer surface of a bent portion 36J between one of the upright-portions 36F and flanges 36G to an outer surface of a bent portion 36J between the other of the upright-portions 36F and flanges 36G of the second pressed-article 36.

An inner surface of the guiding-section 44B of the recess 44A of the third upper die 44 includes the guiding-surfaces 44E that are inclined toward the die-center C on progression from the lower-side D side on the third lower die 46 side toward the upper-side U side which is interior side. An inner surface of the pressing-section 44C of the recess 44A includes pressing-section wall-surfaces 44F that extend along the pressing direction which is upper-side U and lower-side D, from the respective guiding-surfaces 44E toward the interior side. On the other hand, the inner surface of the pressing-section 44C includes pressing-corners 44G which is constituted by curved-surfaces provided at end portions of the respective pressing-section wall-surfaces 44F, and a pressing-section bottom-surface 44H which is provided so as to couple the two pressing-corners 44G together.

The pressing-section bottom-surface 44H is parallel to the top surface 46A of the third lower die 46, and the pressing-section bottom-surface 44H and the pressing-section wall-surfaces 44F are orthogonal to each other. Accordingly, as illustrated in FIG. 9, at the point of bottom dead center to which the third upper die 44 has been moved such that the top surface 46A of the third lower die 46 is positioned at the boundary between the guiding-section 44B and the pressing-section 44C of the third upper die 44, a space surrounded by the third upper die 44 and the third lower die 46 has a rectangular shape.

Additionally, as described later, a cross-sectional shape in a lateral cross-section of the quenched member 10 (see FIG. 14) may be trapezoidal shape in which an top surface 48I as an example of one-surface that includes flanges 48H, is slightly shorter than a bottom surface 48D. In this case, the pressing-section wall-surfaces 44F and the pressing-section bottom-surface 44H are not orthogonal to each other, and a gap between the pressing-section wall-surfaces 44F becomes slightly narrower on progression toward the pressing-section bottom-surface 44H, corresponding to the cross-sectional shape of the quenched member 10. Therefore, angles formed between the pressing-section wall-surfaces 44F and the pressing-section bottom-surface 44H become obtuse.

(Third Process Using Third Pressing Apparatus)

When pressing is performed by use of the third pressing apparatus 42, the narrow-width flat-portion 36D of the main body 36A of the second pressed-article 36 is placed and set on the top surface 46A of the third lower die 46, and the third upper die 44 is lowered by the moving apparatus as illustrated in FIG. 8.

Then, the bent portion 36J between one of the upright-portions 36F and flanges 36G, and the bent portion 36J between the other of the upright-portions 36F and flanges 36G of the second pressed-article 36 contact the guiding-surfaces 44E of the recess 44A of the third upper die 44. In this state, as the third upper die 44 continues to be lowered, the one bent portion 36J and the other bent portion 36J of the second pressed-article 36 are guided by the corresponding guiding-surfaces 44E. Therefore, each of the upright-portions 36F projecting upward from the narrow-width flat-portion 36D is raised toward the side of the opposing upright-portion 36F.

Then, when the one bent portion 36J and the other bent portion 36J of the second pressed-article 36 reach end portions of the guiding-surfaces 44E, a terminal edge EG of one of the flanges 36G and a terminal edge EG of the other of the flanges 36G of the second pressed-article 36 approach each other.

In this state, as the third upper die 44 continues to be lowered, the respective flanges 36G contact the pressing-section bottom-surface 44H of the third upper die 44 and are tilted toward a side of the third lower die 46, as illustrated in FIG. 9. Then, the bent portions 36J (see FIG. 8) between the flanges 36G and the upright-portions 36F are bent following the pressing-corners 44G of the third upper die 44. Therefore, the terminal edges EG of the respective flanges 36G are aligned with each other, and the main body 36A is formed with a rectangular cross-section in a space of the pressing-section 44C surrounded by the third upper die 44 and the third lower die 46.

At the time, as illustrated in FIG. 4, the undulating portions 26 are formed to the flanges 36G at gaps in the length-direction NH. Each of the undulating portions 26 is constituted by the curved-portions 26A that is curved in the thickness direction of the flanges 36G (24G in FIG. 4). And, the undulating shapes constituted by the curved-portions 26A on one of the flanges 36G (24G in FIG. 4) and the undulating shapes constituted by the curved-portions 26A on the other of the flanges 36G (24G in FIG. 4) are formed so as to be phase-offset with respect to each other by half a period in the length-direction.

Accordingly, one of the terminal edges EG and the other of the terminal edges EG may contact each other at intersecting-portions KB (see FIG. 16) in which the undulating portions 26 formed to the one flange 36G (24G in FIG. 4) and the undulating portions 26 formed to the other flange 36G (24G in FIG. 4) intersect with each other. Therefore, it is possible to prevent the upright-portions 36F from collapsing inward.

Here, "in one of the terminal edges EG and the other of the terminal edges EG may contact each other" does not necessary indicate a state in which the one terminal edge EG and the other terminal edge EG are contact each other. The expression includes cases in which the one terminal edge EG and the other terminal edge EG contact each other during pressing when one of the upright-portions 36F collapses toward the side of the opposing upright-portion 36F when subjected to an external force or the like.

(Pressed Intermediate Article)

Figure 10:
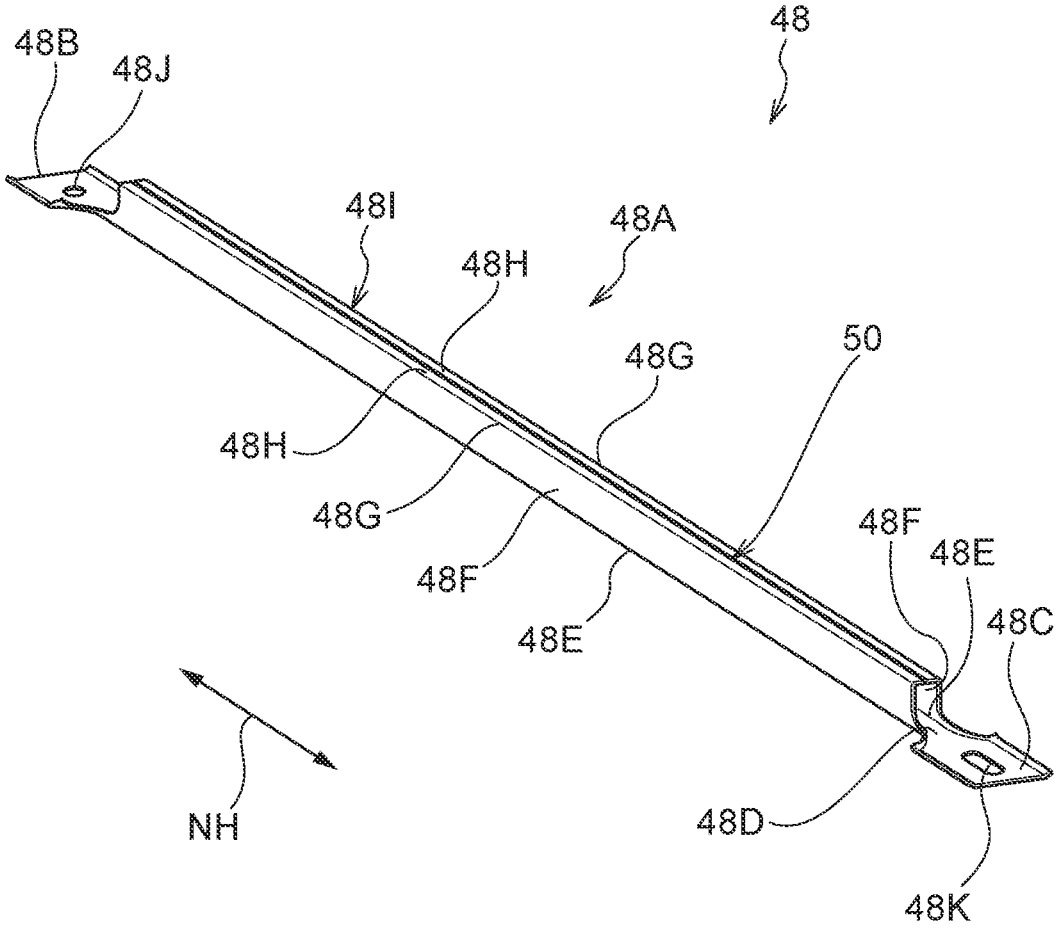
FIG. 10 is a perspective view illustrating a pressed intermediate article pressed in the third process.

FIG. 10 is a view illustrating a pressed intermediate article 48 pressed by use of the third pressing apparatus 42 in the third process 40.

A main body 48A of the pressed intermediate article 48 includes the flat bottom surface 48D that is continuous to a first supporting-portion 48B and a second supporting-portion 48C, lower ridge-lines 48E implemented on side-edges of the bottom surface 48D, and side-surfaces 48F projecting upward from the respective lower ridge-lines 48E.

The main body 48A of the pressed intermediate article 48 is formed with the top surface 48I constituted by the pair of flanges 48H which is provided and coupled to the respective side-surfaces 48F through upper ridge-lines 48G. A terminal portion 50 at which the terminal edges EG of the flanges 48H are aligned with each other is formed along the length-direction NH at the center of the width-direction of the top surface 48I. Therefore, the two terminal edges EG of the steel sheet 12 are aligned with each other at a same side of the rectangular cross-section.

Here, the "terminal portion 50 at which the terminal edges EG of the flanges 48H are aligned with each other" refers to a portion of the rectangular cross-section formed by the main body 48A of the pressed intermediate article 48, and the terminal edges EG of the steel sheet 12 are adjacent to and face each other at a same side in the portion. The adjacent and facing terminal edges EG are separated from each other at the terminal portion 50. The facing terminal edges EG may contact each other locally at a portion of the terminal portion 50 in the length-direction.

As described above, in cases in which the pressing-section bottom-surface 44H and the pressing-section wall-surfaces 44F are not orthogonal to each other and the gap between the pressing-section wall-surfaces 44F becomes slightly narrower on progression toward the pressing-section bottom-surface 44H, the cross-sectional shape of the main body 48A of the pressed intermediate article 48 has a trapezoidal shape. The rectangular cross-section referred to herein encompasses such trapezoidal shapes.

The quenched member 10 illustrated in FIG. 13 is pressed by subjecting the trapezoidal shaped pressed intermediate article 48 to a fourth process (heating process) and a fifth process (quenching process) described later. When a bending moment acts on the quenched member 10 in a direction in which the top surface 48I including the flanges 48H are at an outer side of the bending and the bottom surface 48D is at an inner side of the bending, tensile force in an elongation-direction of the quenched member 10 arises at the flanges 48H. Additionally, tensile force arises in the flanges 48H in a width-direction orthogonal to the elongation-direction of the quenched member 10.

At the same time, compression force in the elongation-direction of the quenched member 10 arises in the bottom surface 48D, and additionally, compression force in the width-direction orthogonal to the elongation-direction of the quenched member 10 arises in the bottom surface 48D. The tensile force in the width-direction of the flanges 48H and the compression force in the width-direction of the bottom surface 48D acts so as to cause the side-surfaces 48F to collapse in a direction causing the flanges 48H to approach each other. However, the flanges 48H are formed with the undulating portions 26 constituted by the curved-portions 26A that is curved in the thickness direction, and the undulating shapes of the curved-portions 26A on the one flange 48H and the curved-portions 26A on the other flange 48H are formed so as to be phase-offset with respect to each other by half a period in the length-direction, such that one of the terminal edges EG of the two opposing flanges 48H contacts the other of the terminal edges EG, it is possible to prevent the side-surfaces 48F from collapsing inward. Therefore, enables it is possible to prevent the quenched member 10 from locally buckling and folding as a result of bending moment.

The angles formed between the bottom surface 48D and the side-surfaces 48F (angles of the lower ridge-lines 48E in cross-section) may be slightly acute in order to more actively promote the side-surfaces 48F to collapse inward in a direction in which the flanges 48H approach each other.

If the angles formed between the bottom surface 48D and the side-surfaces 48F are too small, the width of the flanges 48H becomes narrow. As a result, strength of the pressed intermediate article 48 (quenched member 10) is decreased. Accordingly, it is not preferable for the angles formed between the bottom surface 48D and the side-surfaces 48F to be too small. The angles formed between the bottom surface 48D and the side-surfaces 48F are preferably from 80 degrees to 90 degrees.

Here, in the present embodiment, explanation is given regarding an example which in the main body 48A, the angles between the bottom surface 48D and the side-surfaces 48F are substantially 90 degrees, and the angles between the top surface 48I and the side-surfaces 48F are also substantially 90 degrees. Moreover, the bottom surface 48D and the top surface 48I are substantially parallel to each other and two side-surfaces 48F are substantially parallel to each other, such that the main body 48A has a rectangular cross-section.

Additionally, although in the present embodiment, explanation is given regarding an example in which the angles between the bottom surface 48D and the side-surfaces 48F, these being an example of opposing-surfaces of the main body 48A, are substantially 90 degrees, the curved-portions 26A is not limited to this configuration. That the angles formed between the bottom surface 48D and the side-surfaces 48F be from 80 degrees to 100 degrees is sufficient.

<Fourth Process (Heating Process)>

In a fourth process as an example of a heating process, the pressed intermediate article 48 pressed in the third process 40 is heated by a heating furnace to the Ac3 transformation point of the steel sheet 12 or higher. The illustration of the heating furnace in the drawing is omitted.

A gas furnace, an electric furnace, an electric resistance furnace, an infrared furnace, and a high-frequency furnace are included as the heating furnace.

The Ac3 transformation point which represents the austenite transformation temperature is a temperature at which the steel sheet 12 becomes austenite. The steel sheet 12 is configured from the above-mentioned steel material. For example, the Ac3 transformation point is expressed by the following Equation.

$$Ac3(^\circ\text{ C.})=910-203\times\sqrt{C}(\text{mass }\%)+44.7\times Si(\text{mass }\%)-30\times Mn(\text{mass }\%)-11\times Cr(\text{mass }\%)+700\times S(\text{mass }\%)+400\times Al(\text{mass }\%)+50\times Ti(\text{mass }\%)$$

<Fifth Process (Quenching Process)>

Figure 11:
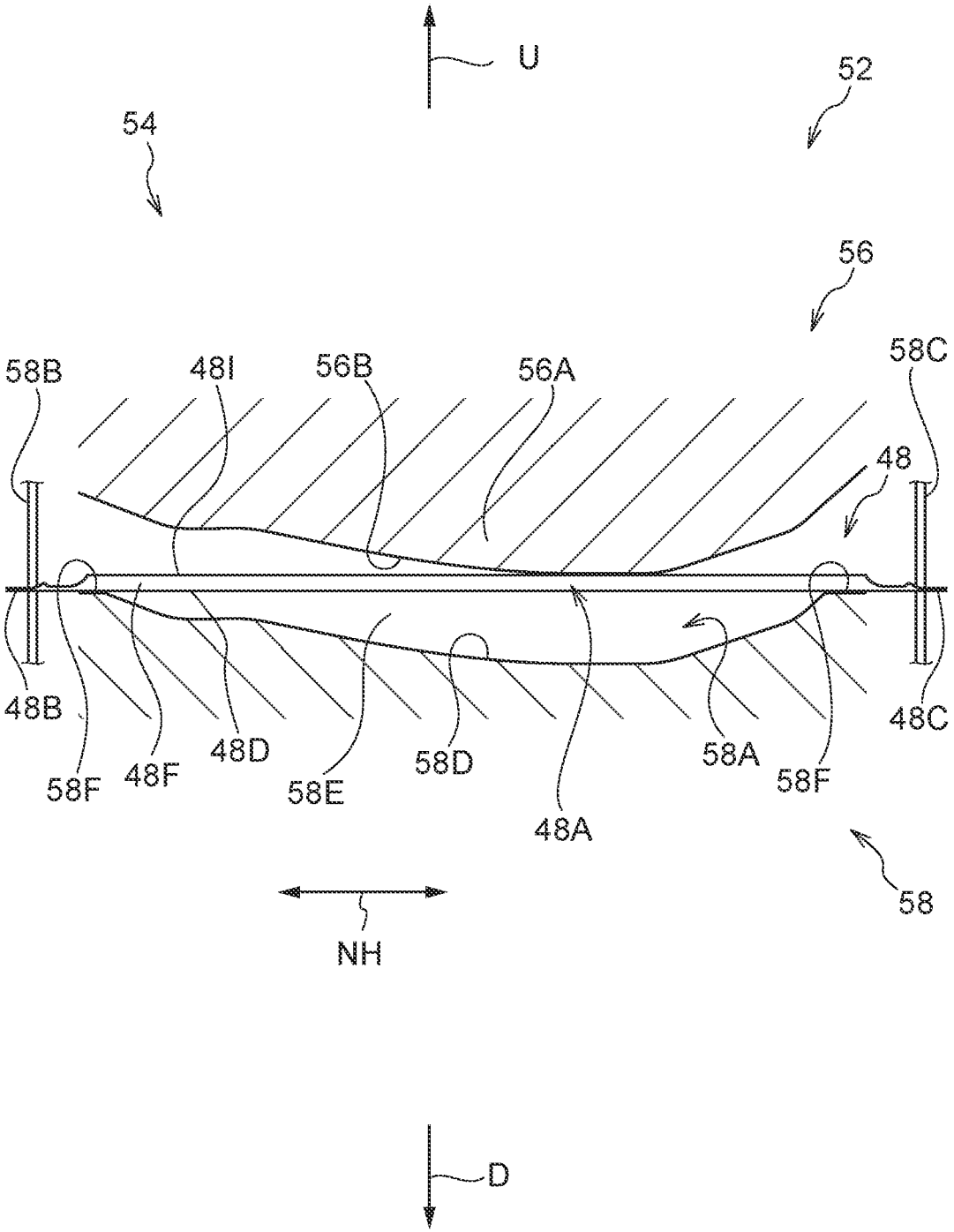
FIG. 11 is a schematic view illustrating a fifth process in the method of manufacturing a quenched member according to the first embodiment, taken from the side of a pressing apparatus.
Figure 12:
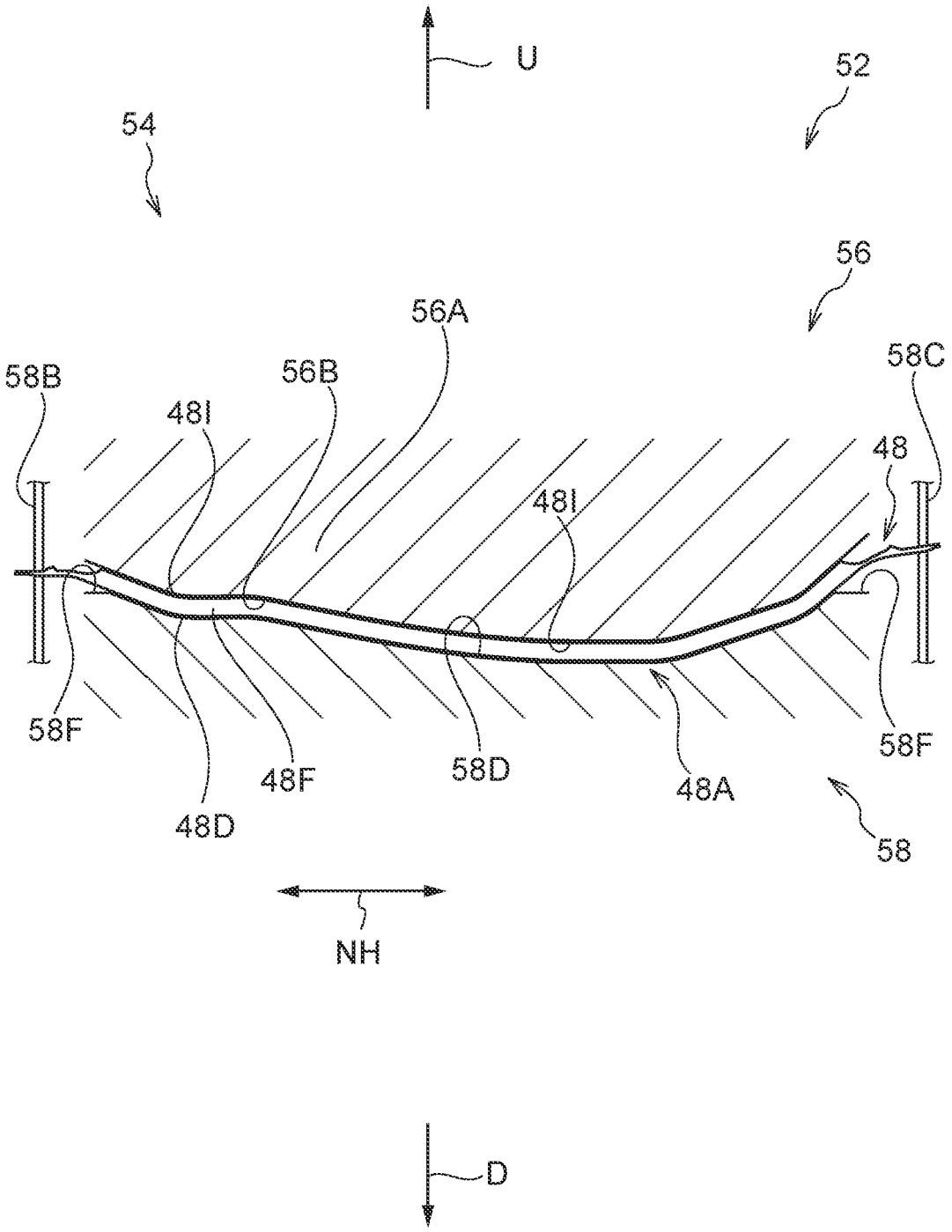
FIG. 12 is a schematic view illustrating the fifth process following on from FIG. 11, taken from the side of the pressing apparatus.
Figure 13:
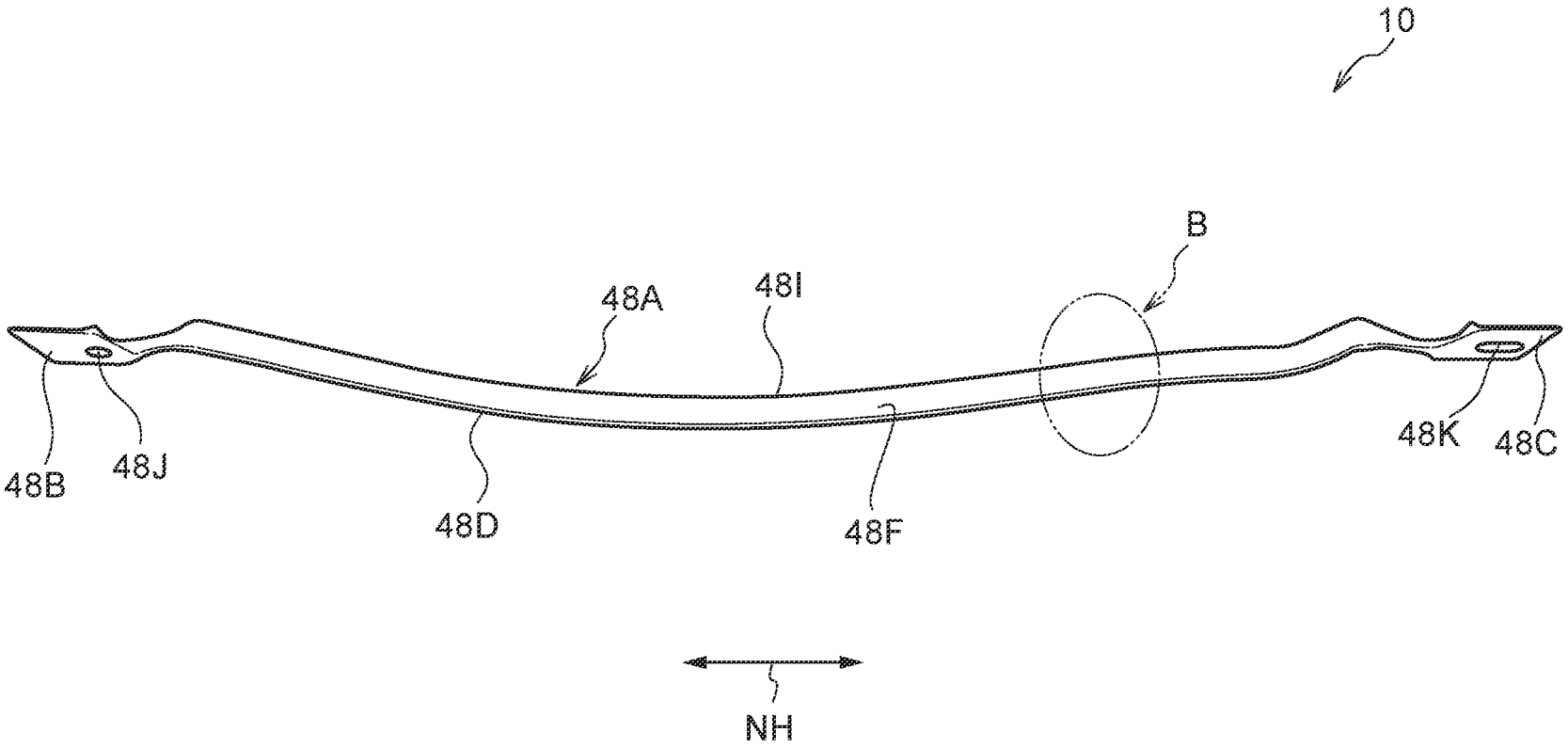
FIG. 13 is a side view illustrating a quenched member according to the first embodiment.

As illustrated in FIG. 11 and FIG. 12, the pressed intermediate article 48 that has been heated to the Ac3 transformation point or higher in the fourth process is hot-pressed by a hot-pressing apparatus 54 in a fifth process 52 as an example of a quenching process.

(Structure of Hot-Pressing Apparatus)

As illustrated in FIG. 11, the hot-pressing apparatus 54 includes a hot-pressing upper die 56 and a hot-pressing lower die 58.

A groove-portion 58A which open on upper-side U is provided at the hot-pressing lower die 58. The groove-portion 58A has a size capable of housing the main body 48A of the pressed intermediate article 48, and a central region in length-direction NH is indented toward lower-side D in the groove-portion 58A. Additionally, a part of the groove-portion 58A is curved so as to project toward the upper-side U.

A first positioning-pin 58B is provided to stand at one side of the hot-pressing lower die 58 in length-direction NH. The first positioning-pin 58B is capable of being inserted into a round hole 48J (see FIG. 10) and the round hole 48J is implemented at the first supporting-portion 48B of the pressed intermediate article 48. The first positioning-pin 58B prevents the pressed intermediate article 48 from tipping. A second positioning-pin 58C is provided to stand at the other side of the hot-pressing lower die 58 in length-direction NH. The second positioning-pin 58C is capable of being inserted into an elongated hole 48K (see FIG. 10) and the elongated hole 48K is implemented at the second supporting-portion 48C of the pressed intermediate article 48. The second positioning-pin 58C prevents the pressed intermediate article 48 from tipping, and absorbs pressing tolerance of the pressed intermediate article 48.

The hot-pressing upper die 56 is disposed with facing the hot-pressing lower die 58, and is coupled to a moving apparatus. The illustration of the moving apparatus in the drawing is omitted. The moving apparatus is, for example, constituted by a hydraulic device, an electrically-driven device, or the like, and moves the hot-pressing upper die 56 toward a pressing direction which is upper-side U or lower-side D with respect to the hot-pressing lower die 58.

A protruding ridge 56A that corresponds to the groove-portion 58A of the hot-pressing lower die 58 is provided at the hot-pressing upper die 56, and an intermediate region of the protruding ridge 56A in length-direction NH is curved toward the hot-pressing lower die 58. The protruding ridge 56A of the hot-pressing upper die 56 is inserted into the groove-portion 58A of the hot-pressing lower die 58 to arrive at a state in which the hot-pressing upper die 56 has reached bottom dead center. Then, as illustrated in FIG. 12, the bottom surface 48D of the main body 48A of the pressed intermediate article 48 in the groove-portion 58A and a groove bottom-surface 58D make surface-contact. In Addition, the top surface 48I of the pressed intermediate article 48 and a bottom surface 56B of the protruding ridge 56A of the hot-pressing upper die 56 make surface-contact. At the time, the side-surfaces 48F of the pressed intermediate article 48 and a groove wall-surface 58E (see FIG. 11) of the groove-portion 58A make surface-contact.

Therefore, the heat of the pressed intermediate article 48 which has been heated to the Ac3 transformation point or higher is rapidly removed by the hot-pressing upper die 56 and the hot-pressing lower die 58, and the pressed intermediate article 48 is cooled and quenched (transformed to martensite).

In the other hand, the curved-portions 26A pressed to the flanges 48H of the pressed intermediate article 48 are curved so as to project toward the inner side. Accordingly, it is possible to simplify the shape of the hot-pressing upper die 56, such as undulations are not provided at locations, which corresponds to the curved-portions 26A, on the bottom surface 56B of the hot-pressing upper die 56, compared to cases in which the curved-portions 26A are curved so as to project toward the outer side.

(Fifth Process Using Hot-Pressing Apparatus)

When pressing is performed by use of the hot-pressing apparatus 54, as illustrated in FIG. 11, the pressed intermediate article 48 is disposed such that the top surface 48I which includes the terminal portion 50 is on a side of the hot-pressing upper die 56, and the first positioning-pin 58B is inserted through the round hole 48J (see FIG. 10) in the first supporting-portion 48B. The second positioning-pin 58C is inserted through the elongated hole 48K (see FIG. 10) in the second supporting-portion 48C. Therefore, the pressed intermediate article 48 is positioned and prevented from tipping. End portions of the pressed intermediate article 48 are set on and supported by upper end-surfaces 58F of the hot-pressing lower die 58.

In this state, the hot-pressing upper die 56 is lowered by the moving apparatus, and the bottom surface 56B of the protruding ridge 56A of the hot-pressing upper die 56 contacts the top surface 48I of the pressed intermediate article 48. Then, the hot-pressing upper die 56 is lowered further, such that the protruding ridge 56A of the hot-pressing upper die 56 is inserted into the groove-portion 58A of the hot-pressing lower die 58 as illustrated in FIG. 12.

Then, the main body 48A of the pressed intermediate article 48 is curved so as to follow the bottom surface 56B of the protruding ridge 56A of the hot-pressing upper die 56 and the groove bottom-surface 58D of the hot-pressing lower die 58, such that the top surface 48I including the terminal portion 50 curves toward an outer side of the one-surface orthogonal to the top surface 48I. Therefore, the pressed intermediate article 48 is bent such that the main body 48A is curved in the length-direction.

At the time, the second positioning-pin 58C that positions the pressed intermediate article 48 is inserted through the elongated hole 48K in the second supporting-portion 48C. Therefore, the main body 48A is permitted to move in a direction toward an inside of the groove-portion 58A.

On the other hand, the terminal edges EG constituting the terminal portion 50 of the steel sheet 12 are not joined together in the pressed intermediate article 48. Accordingly, aligned surfaces of the terminal edges EG are displaced toward the outer side of the one-surface of the top surface 48I when applying a curve, and therefore, localized buckling is suppressed.

At the time, the undulating portions 26 formed to the pressed intermediate article 48 (see FIG. 4, for example) are set at locations having a large curvature in the length-direction NH of the main body 48A. This enables the terminal edges EG constituting the terminal portion 50 of the steel sheet 12 to more readily undergo deformation toward the outer side of the one-surface, enabling localized buckling to be further suppressed.

In a state in which the hot-pressing upper die 56 has reached bottom dead center, the bottom surface 48D of the pressed intermediate article 48 makes face-against-face contact with the groove bottom-surface 58D of the hot-pressing lower die 58, and the top surface 48I makes face-against-face contact with the bottom surface 56B of the protruding ridge 56A of the hot-pressing upper die 56. The side-surfaces 48F of the pressed intermediate article 48 make face-against-face contact with the groove wall-surface 58E of the hot-pressing lower die 58.

Accordingly, heat of the pressed intermediate article 48 that has been transformed to austenite by heating to the Ac3 transformation point or higher in the fourth process is rapidly removed by the hot-pressing upper die 56 and the hot-pressing lower die 58, such that the pressed intermediate article 48 is cooled and quenched (transformed to martensite).

At the time, because cooling of an inner side-surface of the main body 48A that has a rectangular cross-section begins later than cooling of an outer side-surface, a tilting force toward the inner side arises in the side-surfaces 48F. However, the flanges 48H of the top surface 48I are formed with the undulating portions 26, and the undulating portions 26 on one of the flanges 48H and the undulating portions 26 on the other of the flanges 48H constituting the terminal portion 50 intersect with each other at the intersecting-portions KB (see FIG. 16) in view along a aligning direction TH. Accordingly, the terminal edge EG of the one flange 48H and the terminal edge EG of the other flange 48H contact each other, therefore, it is possible to suppress the side-surfaces 48F from collapsing inward.

(Quenched Member)

FIG. 13 is a view illustrating the quenched member 10 pressed by use of the hot-pressing apparatus 54 in the fifth process 52. With the exception of being curved, the respective configuration portions of the quenched member 10 are either the same as or equivalent to those of the pressed intermediate article 48, and are therefore allocated the same reference numerals.

The main body 48A of the quenched member 10 is formed with a rectangular cross-section by the bottom surface 48D that is continuous to the first supporting-portion 48B and the second supporting-portion 48C, the side-surfaces 48F that project upward from the side-edges of the bottom surface 48D, and the top surface 48I constituted by the flanges 48H that extend from the side-surfaces 48F. The angles formed between the bottom surface 48D and the side-surfaces 48F, and the angles formed between the side-surfaces 48F and the top surface 48I, are each substantially 90 degrees.

In cases in which the quenched member 10 is used as a structural member, the angles formed between the bottom surface 48D and the side-surfaces 48F may be acute angles from 80 degrees to less than 90 degrees in order to control the inward collapse direction of the side-surfaces 48F when bending moment acts in a direction in which the top surface 48I including the flanges 48H is at the bending outer side and the bottom surface 48D is at the bending inner side.

Even in cases in which a bending moment acts on the quenched member 10 in a direction in which the top surface 48I including the flanges 48H is at the bending outer side and the bottom surface 48D is at the bending inner side, inward collapse of the side-surfaces 48F is slight in cases in which the bending moment is small. In such cases, there may be no need to control the inward collapse direction of the side-surfaces 48F.

Moreover, in cases in which the quenched member 10 is used as a structural member that is subjected to a load other than a bending moment, for example a twisting moment, there may be no need to control the inward collapse direction of the side-surfaces 48F. In such cases, in order to control properties of the cross-sectional shape (for example second moment of the area of the cross-section), or for other purposes such as avoiding interference with other articles, the width of the bottom surface 48D may be set slightly narrower than the width of the top surface 48I including the flanges 48H, such that the cross-sectional shape of the quenched member 10 has a trapezoidal shape. In such a quenched member 10, the angles formed between the bottom surface 48D and the side-surfaces 48F become obtuse angles slightly larger than 90 degrees. Moreover, when pressing such a quenched member 10, it would not be possible to press by use of the dies illustrated in FIG. 8 and FIG. 9 in the third process, and so dies having different die shapes would be used.

If the angles formed between the bottom surface 48D and the side-surfaces 48F become too large, the width of the bottom surface 48D becomes narrow. As a result, the strength of the pressed-article 48 (quenched member 10) is decreased. Therefore, it is preferable that the angles of the lower ridge-lines 48E in cross-section are not too large. Accordingly, in cases in which the angles formed between the bottom surface 48D and the side-surfaces 48F are obtuse angles, the angles formed between the bottom surface 48D and the side-surfaces 48F are preferably set so as to be from 90 degrees to 100 degrees.

Figure 14:
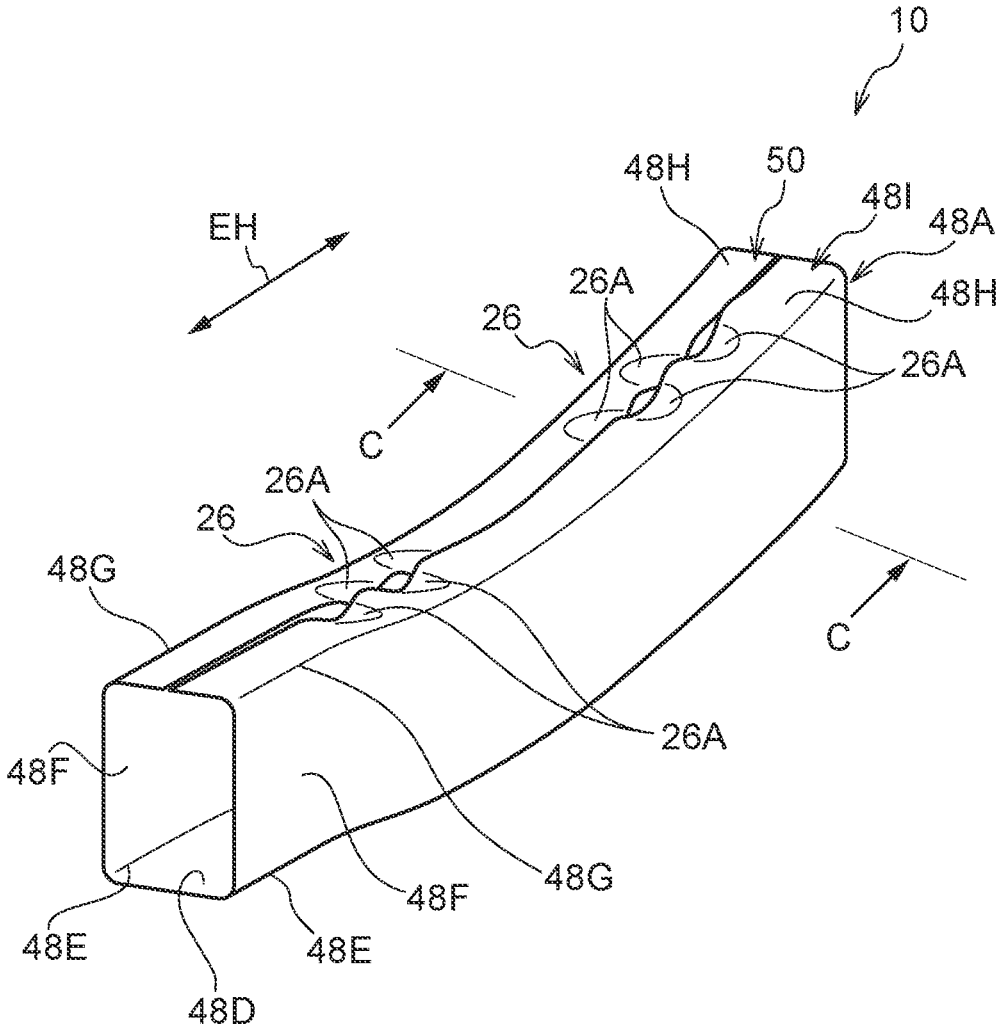
FIG. 14 is an enlarged view of section B in FIG. 13.

FIG. 14 is an enlarged view illustrating section B in FIG. 13. A structure to prevent overlapping is formed by the undulating portions 26 provided at gaps in a direction EH along which the terminal portion 50 extends, at the top surface 48I of the main body 48A of the quenched member 10.

Figure 15:
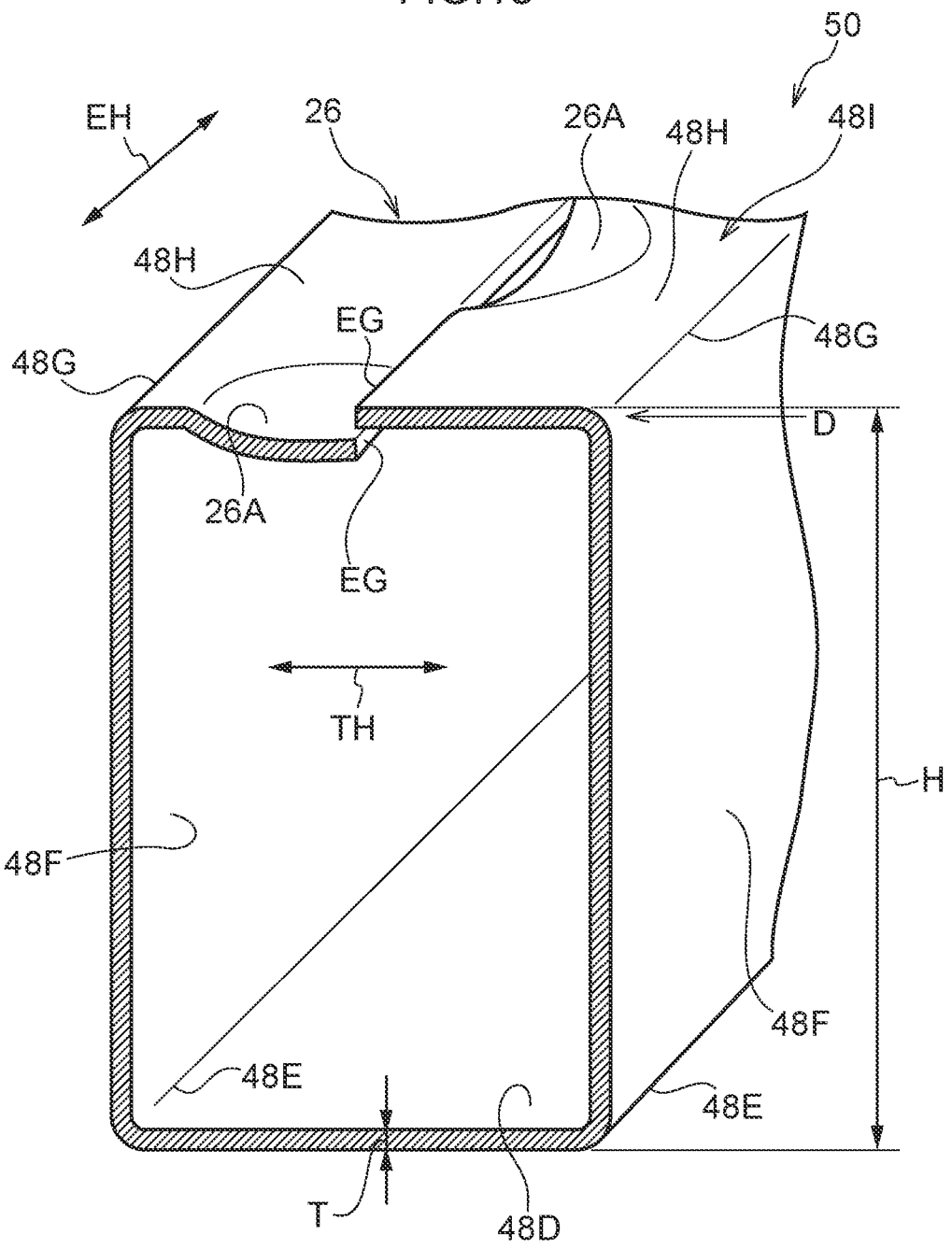
FIG. 15 is a cross-sectional view taken along C-C in FIG. 14.

As illustrated in FIG. 14 and FIG. 15, the undulating portions 26 are formed by the curved-portions 26A pressed on in one of the terminal edges EG and the curved-portions 26A pressed on the other of the terminal edges EG of the steel sheet 12 configured with the terminal portion 50. The curved-portions 26A on the one terminal edge EG and the curved-portions 26A on the other terminal edge EG are located in different positions from each other, but partially overlapping, positions in the direction EH along which the terminal portion 50 extends.

Figure 16:
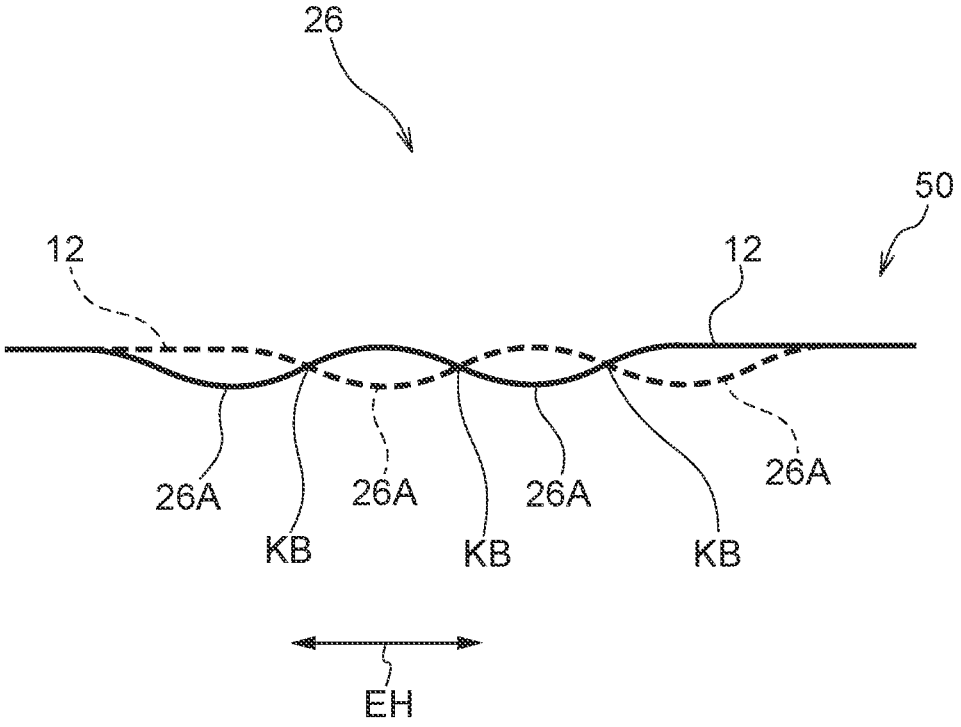
FIG. 16 is a partially see-through view taken along a direction D in FIG. 15.

Specifically, as illustrated in FIG. 16, the undulations of the undulating portions 26 constituted by the curved-portions 26A are phase-offset with respect to each other by half a period in the direction EH along which the terminal portion 50 extends. Accordingly, the undulating portions 26 form the intersecting-portions KB at which the terminal edges EG constituting the terminal portion 50 intersect with each other in view along the aligning direction TH.

<Sixth Process (Final Process)>

In a sixth process as a final process, the first supporting-portion 48B and the second supporting-portion 48C are removed from the main body 48A of the quenched member 10 to implement a finished product.

<Operation and Advantageous Effects>

Explanation follows regarding operation and advantageous effects of the present embodiment.

In the method of manufacturing a quenched member, in the heating process of the fourth process, the pressed intermediate article 48 in which the terminal edges EG of the steel sheet 12 are aligned with each other and has a rectangular cross-section is heated to the Ac3 transformation point of the steel sheet 12 or higher. In the quenching process of the fifth process 52, the quenching is performed with the hot-pressing upper die 56 and the hot-pressing lower die 58 of the hot-pressing apparatus 54. Therefore, the quenched member 10 can be obtained with higher tensile strength as a blank, with higher bending strength as a member, than in pressed-articles that are not quenched. A tensile strength of 1180 MPa or more is possible in such cases.

Moreover, heat escapes less readily after heating and it is possible to suppress a drop in temperature prior to quenching using the hot-pressing apparatus 54, than in cases in which the flat steel sheet 12 is heated and hot-pressed. Accordingly, it is possible to extend permissible duration from the end of the heating process to the start of hot-pressing process, and it is possible to reduce the risk of quenching defects occurring from the drop in temperature. Therefore, it is possible to make the strength uniform through the entire quenched member 10.

Here, in hot-pressing generally, the drop in temperature of the steel sheet after heating is likely to become issues when the sheet-thickness is thin, for example 2.3 millimeters or less. The present embodiment is particularly effective under such conditions.

Furthermore, the pressed intermediate article 48 to be subjected to quenching is processed into a rectangular cross-section. Accordingly, deformation (sagging) during conveyance to a pressing apparatus is suppressed and the conveying operation becomes easy, compared with a case in which the heated flat steel sheet 12 is conveyed. Here, in hot-pressing generally, deformation during conveying the heated steel sheet is likely to become issues when sheet-thickness is especially thin, for example of 1.2 millimeters or less. The present embodiment is particularly effective under such conditions.

Normally, a method would be conceivable in which the heating temperature of the steel sheet 12 in a heating furnace is set high such that the temperature prior to quenching using the hot-pressing apparatus 54 reaches a predetermined value or more. However, in cases in which the workpiece is a plated material to which plating has been applied, a change in the properties of the plating might occur because of setting the high heating temperature in the heating furnace. The method of manufacturing a quenched member of the present embodiment is also effective even for such plated materials.

Figure 17:
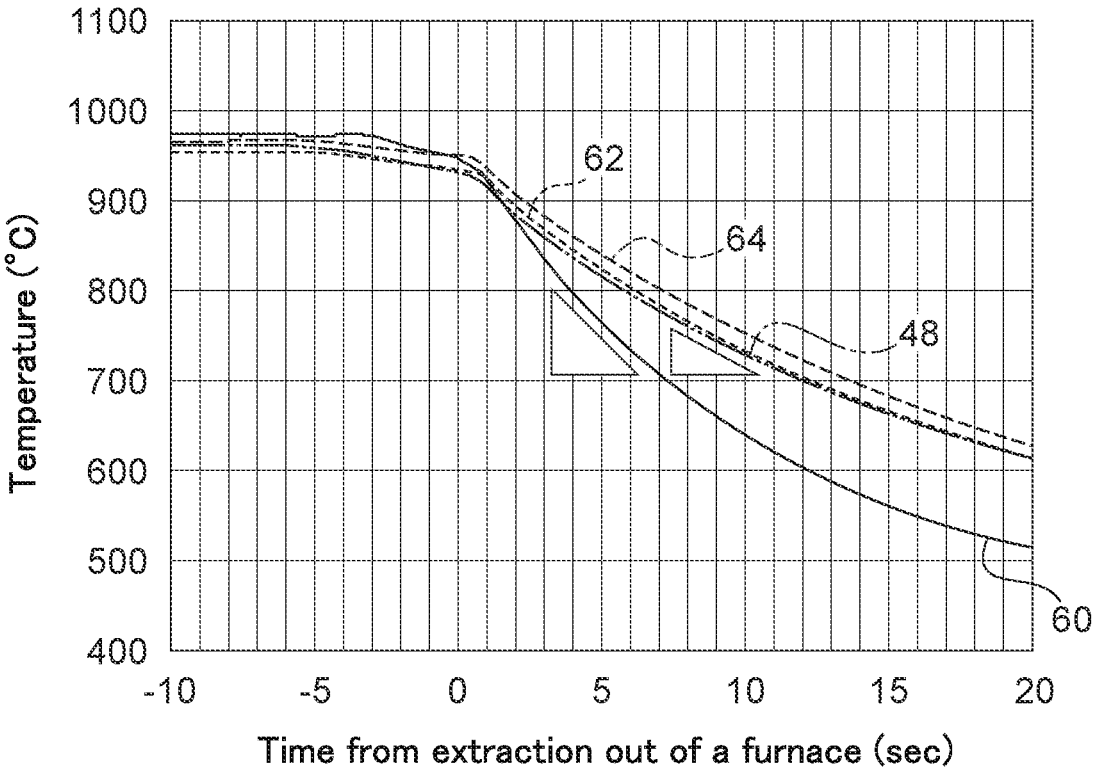
FIG. 17 is a graph illustrating temperature changes against time after extracting respective members from a furnace.

FIG. 17 illustrates measurement results when temperature changes after extracting members with different sheet-thicknesses from a heating furnace are measured. FIG. 17 illustrates the temperature changes when the members heated to 950° C. in the heating furnace have been extracted from the heating furnace.

FIG. 17 illustrates the temperature changes in the pressed intermediate article 48 of the present embodiment in which the steel sheet has a sheet-thickness T of 0.8 millimeters and is configured with the rectangular cross-section, and the temperature changes in a first comparative example 60 in which a sheet-thickness T is 0.8 millimeters and the sheet is configured with a flat shape. FIG. 17 also illustrates the temperature changes in a second comparative example 62 in which a sheet-thickness T is 1.6 millimeters and the sheet is configured from a flat GA material (alloyed zinc plated steel sheet), and a third comparative example 64 in which a sheet-thickness T is 1.6 millimeters and the sheet is configured from a flat steel sheet.

In the first comparative example 60 configured from flat steel sheet with a sheet-thickness T of 0.8 millimeters, it can be estimated that the temperature drops rapidly from one second after extracting out of the furnace. On the other hand, in the pressed intermediate article 48 with a sheet-thickness T of 0.8 millimeters and the rectangular cross-section, the drop of temperature after extracting out of the furnace is more gradual. The pressed intermediate article 48 has substantially the same temperature changes as in the second comparative example 62 configured from a flat GA material with a sheet-thickness T of 1.6 millimeters and in the third comparative example 64 configured from flat a steel sheet with a sheet-thickness T of 1.6 millimeters.

By this testing, it can be estimated that the pressed intermediate article 48 of the present embodiment has equivalent temperature-retention ability to the respective comparative examples 62, 64 which are flat and have a sheet-thickness T of 1.6 millimeters.

And, in the quenching process of the fifth process, the pressed intermediate article 48 is hot-bended and quenched so that the top surface 48I including the terminal portion 50 is curved toward the outer side of the one-surface in the direction EH along which the terminal portion 50 extends. Accordingly, the quenching and the bending of the pressed intermediate article 48 can be performed at the same time, it is therefore possible to shorten the manufacturing time.

The quenched member 10 obtained through this has the rectangular cross-section with four ridge-lines implemented by the lower ridge-lines 48E and the upper ridge-lines 48G that extend in the length-direction NH. Therefore, it is possible to raise bending rigidity, compared to a channel shape in cross-section with two ridge-lines extending along the length-direction NH. Accordingly, it is possible to make the cross-sectional shape of the quenched member 10 smaller while maintaining a desired bending rigidity, and reduction in weight becomes possible.

Additionally, it is possible to obtain excellent dimensional precision of the quenched member 10 more easily than in cases in which a curve is applied by cold pressing, because the pressed intermediate article 48, which is heated to the Ac3 transformation point or higher in the heating process of the fourth process, is bent.

Here, in general cases in which a thin steel sheet is pressed into a channel shape, an inner side and an outer side of the channel shape are restrained by a die, and pressing into a desired channel shape is performed.

However, in the present embodiment, since only an outer side of the pressed intermediate article 48 which has the rectangular cross-section is restrained by a die, a concern that the side-surfaces 48F collapse inward, toward an inner side of the rectangular cross-section might occur.

In particular, when the pressed intermediate article 48 is cooled from the outer side at the start of hot-pressing, tilting of the side-surfaces 48F toward the outer side is suppressed by the hot-pressing lower die 58. In this state, when the inner side of the pressed intermediate article 48 starts to cool, the concern of the side-surfaces 48F collapsing inward might occur because a tilting force toward the inner side acts on the side-surfaces 48F.

However, in the pressed intermediate article 48 of the present embodiment, the terminal edges EG, which constitute the terminal portion 50 of the steel sheet 12, contact locally with each other. Accordingly, the terminal edges EG in the terminal portion 50 butt each other before the side-surfaces 48F collapse inward, therefore, it is possible to suppress the side-surfaces 48F from collapsing inward. Therefore, it is possible to suppress the rectangular cross-section from collapsing.

In the terminal edges EG of the steel sheet 12, the curved-portions 26A that are curved toward the inner side of the rectangular cross-section, and the intersecting-portions KB, in which the terminal edges EG in the terminal portion 50 intersect with each other in view along the aligning direction TH, are formed. Therefore, it is possible to maintain contact state between the terminal edges EG even if the terminal edges EG in the terminal portion 50 shift toward the direction along the sheet-thickness.

Moreover, the curved-portions 26A are pressed at each of the terminal edges EG in the terminal portion 50, and the curved-portions 26A pressed to in one of the terminal edges EG and the curved-portions 26A pressed to in the other of the terminal edges EG are located in different positions from each other in the direction EH along which the terminal portion 50 extends. Accordingly, a phase of the undulations which is implemented by the adjacent curved-portions 26A in the one terminal edge EG and a phase of the undulations of the other terminal edge EG are delineated so as to be offset with respect to each other by half a period in the length-direction.

By this configuration, it is possible to enlarge the contact range between the terminal edges EG, and possible to suppress the terminal edges EG from slipping past each other.

And, the curved-portions 26A are pressed so as to have a curved shape which projects toward the inner side of the rectangular cross-section of the pressed intermediate article 48. Therefore, it is possible to make the top surface 48I including the curved-portions 26A contact tighter at locations for reinforcement than in cases of curved shapes in which the curved-portions 26A project toward the outer side of the rectangular cross-section.

Additionally, the curved-portions 26A are pressed at the time of cold pressing in the first process 14 as an example of a pressing process. Therefore, it is possible to execute pressing the flanges 24G and pressing the curved-portions 26A at the same time.

And, the pressed intermediate article 48 that has the rectangular cross-section is pressed by use of the hot-pressing upper die 56 and the hot-pressing lower die 58 that restrain from the outer side. Therefore, it is possible to simplify the die structure, compared to cases in which a core is inserted into the inner side of the pressed intermediate article 48, or cases in which a movable die is used to press the upright-portions 36F of the second pressed-article 36 from a side direction.

Additionally, although explanation has been given regarding a case in which the curve shaped curved-portions 26A are included in the terminal edges EG in the terminal portion 50 in the present embodiment, the shape of the curved-portions 26A are not limited to this shape, and may be configured as in the following embodiment.

Second Embodiment

Figure 18:
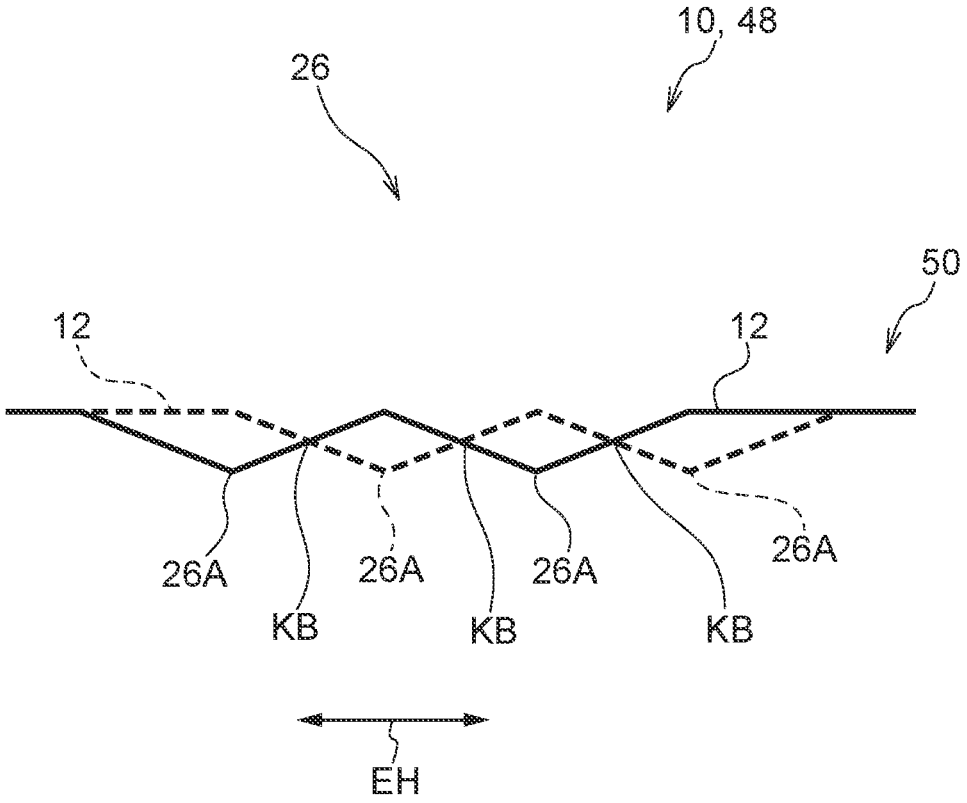
FIG. 18 is a view illustrating a second embodiment, corresponding to a partially see-through view taken along a direction D in FIG. 15.

FIG. 18 is a view illustrating a second embodiment. Portions equivalent or similar to portions in the first embodiment are allocated the same reference numerals and explanation of the portions is omitted, with explanation only being given regarding portions that differ.

FIG. 18 is a view corresponding to a partially see-through view taken along the direction D in FIG. 15 relating to the first embodiment. In the pressed intermediate article 48 and the quenched member 10 according to the present embodiment, the terminal edges EG of This configuration enables operation and advantageous effects similar to the operation and advantageous effects of the first embodiment, and the curved-portions 26A pressed to the terminal edges EG are formed in V-shapes projecting toward the inner side of the rectangular cross-section. Therefore, the undulating portion 26, which is constituted by adjacent curved-portions 26A, delineates angular lines in view along the aligning direction TH.

This configuration enables similar operation and advantageous effects to those of the first embodiment.

Additionally, although in the present embodiment, explanation has been given regarding a case in which the curved-portions 26A pressed to the terminal edges EG of the steel sheet 12 project toward the inner side of the rectangular cross-section, the curved-portions 26A is not limited to this configuration, may be configured as in the following embodiment.

Third Embodiment

Figure 19:
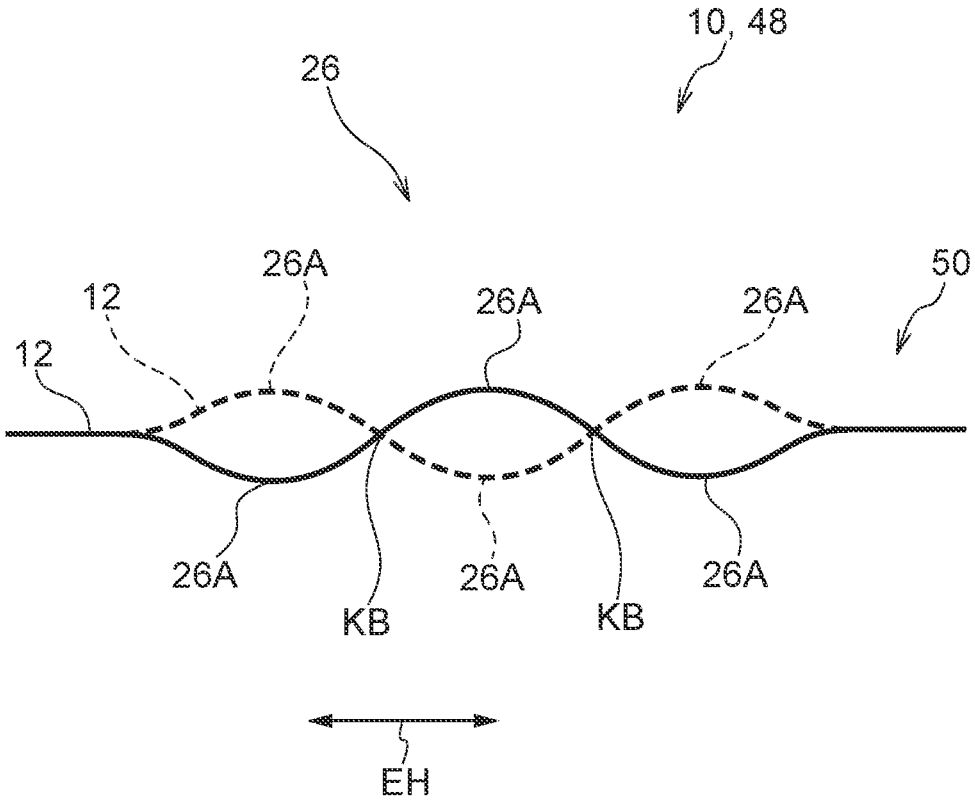
FIG. 19 is a view illustrating a third embodiment, corresponding to a partially see-through view taken along the direction D in FIG. 15.

FIG. 19 is a view illustrating a third embodiment. Portions equivalent or similar to portions in the first embodiment are allocated the same reference numerals and explanation of the portions is omitted, with explanation only being given regarding portions that differ.

FIG. 19 is a view corresponding to a partially see-through view taken along the direction D in FIG. 15 relating to the first embodiment. In the pressed intermediate article 48 and the quenched member 10 according to the present embodiment, the curved-portions 26A pressed to the terminal edges EG constituting the terminal portion 50 project toward both the inner side and the outer side of the rectangular cross-section.

This configuration enables similar operation and advantageous effects to those of the first embodiment.

Additionally, although in the present embodiments, explanation has been given regarding cases in which the curved-portions 26A are pressed to the two terminal edges EG constituting the terminal portion 50 of the steel sheet 12, the curved-portions 26A is not limited to this configuration, and may be configured as in the following embodiment.

Fourth Embodiment

Figure 20:
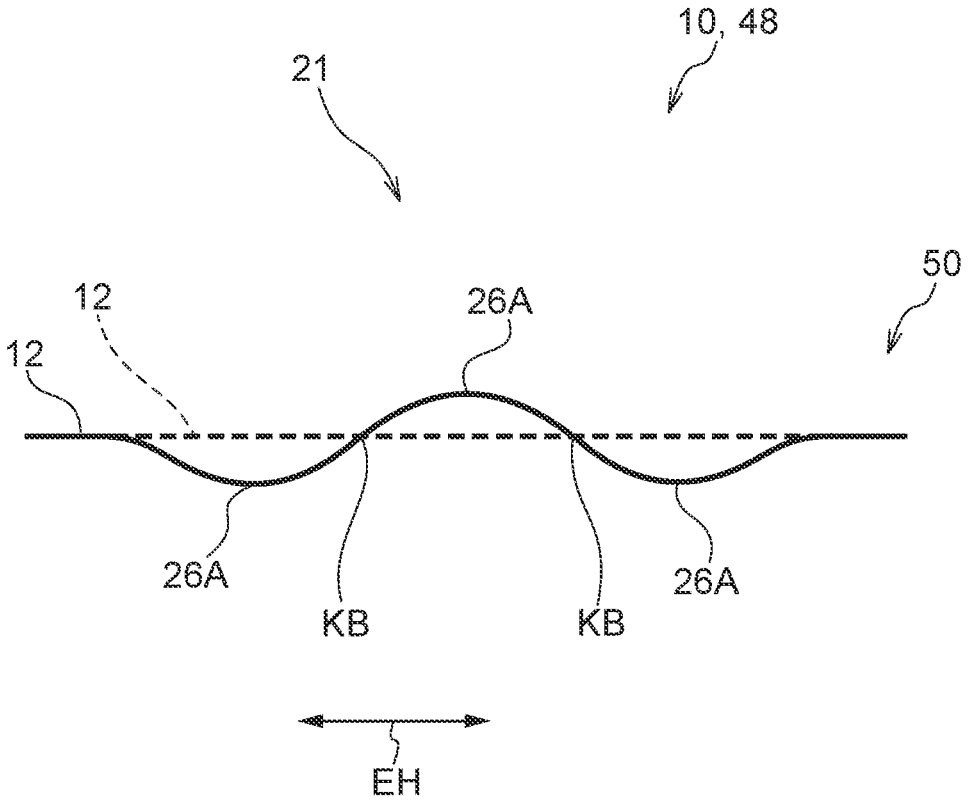
FIG. 20 is a view illustrating a fourth embodiment, corresponding to a partially see-through view taken along the direction D in FIG. 15.

FIG. 20 is a view illustrating a fourth embodiment. Portions equivalent or similar to portions in the first embodiment are allocated the same reference numerals and explanation of the portions is omitted, with explanation only being given regarding portions that differ.

FIG. 20 is a view corresponding to a partially see-through view taken along the direction D in FIG. 15 relating to the first embodiment. In the pressed intermediate article 48 and the quenched member 10 according to the present embodiment, the terminal edges EG of This configuration enables operation and advantageous effects similar to the operation and advantageous effects of the first embodiment, and curved-portions 26A are not pressed to in one of the terminal edges EG, such that the curved-portions 26A are only pressed to the other of the terminal edges EG.

This configuration enables similar operation and advantageous effects to those of the first embodiment.

Additionally, although plural of the intersecting-portions KB are provided at the terminal portion 50 in each of the embodiments, a single intersecting-portion KB may be provided.

Explanation of the reference numerals follows.

10 quenched member
12 steel sheet
26 undulating portion
26A curved-portion
48 pressed intermediate article
48A main body
48D bottom surface (opposing-surface)
48I top surface (one-surface)
50 terminal portion
52 fifth process
54 hot-pressing apparatus
56 hot-pressing upper die
58 hot-pressing lower die
EG terminal edge
KB intersecting-portion
TH aligning direction <<Supplement>>

Following aspects may be generalized from the present specification.

Namely, a first aspect is a method of manufacturing a quenched member, the method including: heating a pressed intermediate article to an Ac3 transformation point of a steel sheet or higher, the intermediate article having been processed so as to have a rectangular cross-section and so as to include a terminal portion at which two terminal edges of the steel sheet are aligned with each other at a same side of the rectangular cross-section, and quenching the heated intermediate article inside a die.

A second aspect is the method of manufacturing a quenched member of the first aspect, wherein quenching the intermediate article includes subjecting the intermediate article to hot bending such that one-surface, which includes the terminal portion, curves toward an outer side of the one-surface along which the terminal portion extends.

A third aspect is the method of manufacturing a quenched member of either the first aspect or the second aspect, wherein the terminal edges of the steel sheet contact each other.

A fourth aspect is the method of manufacturing a quenched member of any one of the first aspect to the third aspect, further comprising pressing the steel sheet into the intermediate article, wherein at least one of the terminal edges, which are aligned at the terminal portion, includes a curved-portion that is partially curved in a direction along a sheet-thickness direction of the steel sheet.

A fifth aspect is the method of manufacturing a quenched member of any one of the first aspect to the fourth aspect, wherein a ratio of a height of the quenched member in a curving direction, to a sheet-thickness of the steel sheet in a lateral cross-section, is 40 or less.

A sixth aspect is the method of manufacturing a quenched member of any one of the first aspect to the fifth aspect, wherein a sheet-thickness of the steel sheet is 2.3 millimeters or less.

A seventh aspect is a quenched member including: one-surface at which terminal edges of a steel sheet are adjacent to and face each other at a same side of a rectangular cross-section of the quenched member, the one-surface curving toward an outer side of the one-surface in a direction along which the terminal edges extend, and an intersecting-portion at which the terminal edges intersect with each other, as viewed in a facing direction along which the terminal edges face each other.

An eighth aspect is the quenched member of the seventh aspect, wherein at least one of the terminal edges includes a curved-portion, the curved-portion being curved toward one side in a sheet-thickness direction of the steel sheet, and the intersecting-portion being included in the curved-portion.

A ninth aspect is the quenched member of the eighth aspect, wherein the curved-portion is curved toward an inner side of the rectangular cross-section.

A tenth aspect is the quenched member of either the eighth aspect or the ninth aspect, wherein the curved-portion is included in each of the terminal edges, and one curved-portion formed in one terminal edge and another curved-portion formed in the other terminal edge are located in different positions from each other in a direction along which the terminal edges extend.

An eleventh aspect is the quenched member of any one of the seventh aspect to the tenth aspect, wherein a ratio of a height of the quenched member in a curving direction, to a sheet-thickness of the steel sheet in a lateral cross-section, is 40 or less.

A twelfth aspect is the quenched member of any one of the seventh aspect to the eleventh aspect, wherein a sheet-thickness of the steel sheet is 2.3 millimeters or less.

A thirteenth aspect is the quenched member of any one of the seventh aspect to the twelfth aspect, wherein an angle formed between an opposing-surface that faces the one-surface, and a side-surface that links the opposing-surface and the one-surface, is from 80 degrees to 100 degrees.

<Other Aspects>

Additionally, following other aspects may be generalized from the present specification.

Namely, another first aspect is a method of manufacturing a quenched member, the method including: a heating process of heating a pressed intermediate article to an Ac3 transformation point of a steel sheet or higher, the intermediate article having been processed so as to have a rectangular cross-section and so as to include a terminal portion at which two terminal edges of the steel sheet are aligned with each other at a same side of the rectangular cross-section, and a quenching process of quenching the intermediate article heated in the heating process inside a die.

Another second aspect is the method of manufacturing a quenched member of the other first aspect, wherein the quenching process of quenching the intermediate article includes subjecting the intermediate article to hot bending such that one-surface, which includes the terminal portion, curves toward an outer side of the one-surface along which the terminal portion extends.

Another third aspect is the method of manufacturing a quenched member of either the other first aspect or the other second aspect, wherein the terminal edges of the steel sheet contact each other.

Another fourth aspect is the method of manufacturing a quenched member of any one of the other first aspect to the other third aspect, comprising a pressing process of pressing the steel sheet into the intermediate article, wherein at least one of the terminal edges, which are aligned at the terminal portion, is formed with a curved-portion that is partially curved in a direction along a sheet-thickness direction of the steel sheet in the pressing process.

Another fifth aspect is the method of manufacturing a quenched member of any one of the other first aspect to the other fourth aspect, wherein a ratio of a height of the quenched member in a curving direction, to a sheet-thickness of the steel sheet, is 40 or less.

Another sixth aspect is the method of manufacturing a quenched member of any one of the other first aspect to the other fifth aspect, wherein a sheet-thickness of the steel sheet is 2.3 millimeters or less.

Another seventh aspect is a quenched member including: a rectangular cross-section, a terminal portion at which terminal edges of a steel sheet are aligned with each other at one-surface, the one-surface curving toward an outer side of the one-surface in a direction along which the terminal portion extend, and an intersecting-portion at which the terminal edges at the terminal portion intersect with each other, as viewed in an aligning direction along which the terminal edges face each other.

Another eighth aspect is the quenched member of the other seventh aspect, wherein at least one of the terminal edges at the terminal portion is formed with a curved-portion, the curved-portion being curved toward one side in a sheet-thickness direction of the steel sheet, and the intersecting-portion being formed.

Another ninth aspect is the quenched member of the other eighth aspect, wherein the curved-portion is formed so as to curve toward an inner side of the rectangular cross-section.

Another tenth aspect is the quenched member of either the other eighth aspect or the other ninth aspect, wherein the curved-portion is formed in each of the terminal edges in which the curved-portion constitutes the terminal portion, and one curved-portion formed in one terminal edge and another curved-portion formed in the other terminal edge are located in different positions from each other in a direction along which the terminal portion extend.

Another eleventh aspect is the quenched member of any one of the other seventh aspect to the other tenth aspect, wherein a ratio of a height of the quenched member in a curving direction, to a sheet-thickness of the steel sheet, is 40 or less.

Another twelfth aspect is the quenched member of any one of the other seventh aspect to the other eleventh aspect, wherein a sheet-thickness of the steel sheet is 2.3 millimeters or less.

These other aspects implement following operation and advantageous effects.

In the other first aspect, after the pressed intermediate article that has been processed into a rectangular cross-section in which the two terminal edges of the steel sheet are aligned with each other has been heated to the Ac3 transformation point or higher, the pressed intermediate article is hot pressed and quenched inside the die. Therefore, it is possible to form the quenched member with high strength and excellent dimensional precision of the curved shape along the longitudinal direction, and without the occurrence of buckling and wrinkles.

Furthermore, a cross-sectional shape of the pressed intermediate article to be quenched is processed so as to be substantially closed. As a result, heat escapes less readily from the heated pressed intermediate article after heating than in cases in which a flat steel sheet is heated and hot pressed, and a drop in temperature is suppressed. Therefore, it is possible to extend duration from the end of the heating process to the start of hot pressing.

Thus, risk of occurring of quenching defects resulting from a drop in temperature is reduced, resulting in a highly robust manufacturing process.

The method of manufacturing a quenched member of the other aspects enables a high strength member with a hollow, rectangular cross-section that is curved in the longitudinal direction to be obtained with excellent dimensional precision, and also enables quenching defects occurring from a drop in temperature to be suppressed.

The disclosure of Japanese Patent Application No. 2017-049911, filed on Mar. 15, 2017, is incorporated in its entirety by reference herein.

All cited documents, patent applications, and technical standards mentioned in the present specification are incorporated by reference in the present specification to the same extent as if each individual cited document, patent application, or technical standard was specifically and individually indicated to be incorporated by reference.

The invention claimed is:

1. A quenched member comprising:

a steel sheet formed into a rectangular cross section having one-surface at which first and second terminal edges of the steel sheet are adjacent to and face each other at a same side of the rectangular cross-section of the quenched member, the one-surface comprising a first undulating portion in the first terminal edge in a direction along which the terminal edges extend, wherein the first undulating portion includes curved portions that are curved in a sheet thickness direction of the steel sheet; and an intersecting-portion at which the first undulating portion in the first terminal edge and the second terminal edge cross each other as viewed perpendicular to a plane that is parallel to the first and second terminal edges, which face each other.

2. The quenched member according to claim 1, wherein of the second terminal edge includes a second undulating portion, the second undulating portion includes curved portions that are curved in the sheet-thickness direction of the steel sheet, and the first undulating portion and the second undulating portion cross each other in the intersecting-portion as viewed perpendicular to a plane that is parallel to the first and second terminal edges, which face each other.

3. The quenched member according to claim 2, wherein the curved portions are curved toward an inner side of the rectangular cross-section.

4. The quenched member according to claim 2, wherein the curved portions of each of the first undulating portion and the second undulating portion are located in different positions from each other in the direction along which the terminal edges extend.

5. The quenched member according to claim 1, wherein the quenched member is curved in a curving direction, and wherein a ratio of a height of the quenched member in the curving direction, to the sheet-thickness of the steel sheet in a lateral cross-section, is 40 or less.

6. The quenched member according to claim 1, wherein the sheet thickness of the steel sheet is 2.3 millimeters or less.

7. The quenched member according to claim 1, wherein an angle formed between an opposing-surface that faces the one-surface, and a side-surface that links the opposing-surface and the one-surface, is from 80 degrees to 100 degrees.

8. A method of manufacturing the quenched member according to claim 1, the method comprising:

heating a pressed intermediate article to an Ac3 transformation point of the steel sheet or higher, the intermediate article having been processed so as to have the rectangular cross-section and so as to include a terminal portion at which the two terminal edges of the steel sheet are aligned with each other at the same side of the rectangular cross-section;

quenching the heated intermediate article inside a die; and further comprising pressing the steel sheet into the intermediate article.

9. The method of manufacturing the quenched member according to claim 8, wherein quenching the intermediate article includes subjecting the intermediate article to hot bending such that the one-surface, which includes the terminal portion, curves toward an outer side of the one-surface along which the terminal portion extends.

10. The method of manufacturing the quenched member according to claim 8, wherein the terminal edges of the steel sheet contact each other.

11. The method of manufacturing the quenched member according to claim 8, wherein a ratio of a height of the quenched member in a curving direction, to a sheet-thickness of the steel sheet in a lateral cross-section, is 40 or less.

12. The method of manufacturing the quenched member according to claim 8, wherein a sheet-thickness of the steel sheet is 2.3 millimeters or less.

* * * * *